US006712699B2

(12) United States Patent
Walker et al.

(10) Patent No.: US 6,712,699 B2
(45) Date of Patent: Mar. 30, 2004

(54) APPARATUS AND METHOD FOR FACILITATING TEAM PLAY OF SLOT MACHINES

(75) Inventors: Jay S. Walker, Ridgefield, CT (US); James A. Jorasch, Stamford, CT (US); Magdalena M. Fincham, Norwalk, CT (US); Geoffrey M. Gelman, Stamford, CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 10/067,576

(22) Filed: Feb. 6, 2002

(65) Prior Publication Data

US 2002/0151365 A1 Oct. 17, 2002

Related U.S. Application Data

(63) Continuation-in-part of application No. 09/590,021, filed on Jun. 8, 2000, now Pat. No. 6,361,441, which is a continuation of application No. 09/052,835, filed on Mar. 31, 1998, now Pat. No. 6,142,872.

(51) Int. Cl.[7] ..... A63F 9/24

(52) U.S. Cl. ..... 463/30; 463/42; 340/323 R

(58) Field of Search ..... 463/1, 9, 12–13, 463/16–20, 25–30, 36, 40–43; 273/143 R, 139, 138.1, 138.2, 292–293, 308, 236–237; 340/323 R; 700/91.93; 705/16–18; 235/375, 380

(56) References Cited

U.S. PATENT DOCUMENTS

| | | | | |
|---|---|---|---|---|
| 4,636,951 | A | 1/1987 | Harlick | 364/412 |
| 4,669,731 | A | 6/1987 | Clarke | 273/143 R |
| 4,837,422 | A | 6/1989 | Dethloff et al. | 235/380 |
| 4,837,728 | A | 6/1989 | Barrie et al. | 364/412 |
| 5,042,818 | A | 8/1991 | Weingardt | 273/292 |
| 5,116,055 | A | 5/1992 | Tracy | 273/138 A |
| 5,123,649 | A | 6/1992 | Tiberio | 273/143 R |
| 5,173,851 | A | 12/1992 | Off et al. | 364/401 |
| 5,178,390 | A | 1/1993 | Okada | 273/143 R |
| 5,179,517 | A | 1/1993 | Sarbin et al. | 364/410 |
| 5,275,400 | A | 1/1994 | Weingardt et al. | 273/85 CP |
| 5,280,909 | A | 1/1994 | Tracy | 273/138 A |
| 5,324,035 | A | 6/1994 | Morris et al. | 273/138 A |
| 5,342,049 | A | 8/1994 | Wichinsky et al. | 273/119 R |
| 5,377,973 | A | 1/1995 | Jones et al. | 273/85 CP |
| 5,393,061 | A | 2/1995 | Manship et al. | 273/143 R |
| 5,409,225 | A | 4/1995 | Kelly et al. | 273/138 R |
| 5,472,194 | A | 12/1995 | Breeding et al. | 273/138 A |
| 5,482,289 | A | 1/1996 | Weingardt | 273/269 |

(List continued on next page.)

FOREIGN PATENT DOCUMENTS

GB 2 161 008 A 1/1986

OTHER PUBLICATIONS

Rose, Bob, "New Ways For the House to Win", St. Louis Post–Dispatch, Oct. 3, 1996, Section: Get Out, p. 50.

"Hot Slots & Reel Deals", Atlantic City Insider, Oct. 1996, vol. 1, No. 2.

"Triple Play Draw Poker Takes Casino Industry By Storm", IGT Press Releases, Feb. 18, 1998, (http //www igtgame com/press/02–18–98 html).

Grochowski, John, "Players Look for Edge With Casino Gimmicks", Chicago Sun–Times, Aug. 25, 1995, Section: Weekend Plus, Gaming, p. 15, NC.

*Primary Examiner*—Mark Sager
(74) *Attorney, Agent, or Firm*—Michael D. Downs

(57) ABSTRACT

A method for team play of slot machines, including determining a first result corresponding to a first player on a team, determining a second result corresponding to a second player, determining whether the second player is on the team, and determining a result based on the first result and the second result if the second player is on the team.

19 Claims, 28 Drawing Sheets

U.S. PATENT DOCUMENTS

| | | | | |
|---|---|---|---|---|
| 5,559,312 | A | 9/1996 | Lucero | 235/380 |
| 5,564,700 | A | 10/1996 | Celona | 463/27 |
| 5,580,309 | A | 12/1996 | Piechowiak et al. | 463/16 |
| 5,611,535 | A | 3/1997 | Tiberio | 273/143 R |
| 5,611,730 | A | 3/1997 | Weiss | 463/20 |
| 5,621,201 | A | 4/1997 | Langhans et al. | 235/380 |
| 5,639,088 | A | 6/1997 | Schneider et al. | 273/138.2 |
| 5,655,961 | A | 8/1997 | Acres et al. | 463/27 |
| 5,674,128 | A | 10/1997 | Holch et al. | 463/42 |
| 6,142,872 | A | 11/2000 | Walker et al. | 463/16 |
| 6,361,441 | B1 * | 3/2002 | Walker | 463/42 |

* cited by examiner

600

| PLAYER IDENTIFIER 630 | PLAYER NAME 635 | ADDRESS 640 | TEAM IDENTIFIER 630 | REWARD POINTS BALANCE 635 |
|---|---|---|---|---|
| 2370493 | JOHN SMITH | 15 RIVER PL. TOWN, USA | 31157 | 500 |
| 2370964 | SUSAN GREEN | 18 MAIN ST. CITY, USA | 31157 | 2,000 |
| 4558123 | MIKE DOE | 30 ROAD DR. VILLAGE, USA | 22182 | 173 |
| 2370964 | JUDY GOLD | 10 BROAD ST. METRO, USA | NONE | 10,563 |

605 610 615 620

FIG. 6

700

| TEAM IDENTIFIER 720 | 1ST PLAYER IDENTIFIER 725 | 2ND PLAYER IDENTIFIER 730 | 3RD PLAYER IDENTIFIER 735 | SESSION DURATION 740 |
|---|---|---|---|---|
| 31157 | 2370493 | 2370964 | 3411190 | 1 HOUR |
| 22182 | 4558123 | 9003418 | 7789013 | 100 PULLS |

705

710

FIG. 7

900

| TEAM IDENTIFIER 920 | PLAYER 1 930 | | | | | PLAYER 2 940 | | | | | PLAYER 3 950 | | | | |
|---|---|---|---|---|---|---|---|---|---|---|---|---|---|---|---|
| | PLAYER ID 931 | REEL 1 932 | REEL 2 933 | REEL 3 934 | MACHINE ID 935 | PLAYER ID 941 | REEL 1 942 | REEL 2 943 | REEL 3 944 | MACHINE ID 945 | PLAYER ID 951 | REEL 1 952 | REEL 2 953 | REEL 3 954 | MACHINE ID 955 |
| 905 31157 | 4558123 | BELL | ORANGE | BELL | 987654 | 9003418 | CHERRY | BAR | CHERRY | 765432 | 7789013 | BAR | CHERRY | BELL | 543210 |
| 910 34156 | 6700251 | BAR | CHERRY | CHERRY | 876543 | 8001372 | BELL | BAR | CHERRY | 654321 | 0926617 | BELL | BELL | BAR | 432109 |

FIG. 9

1000

| TEAM IDENTIFIER 1020 | PLAYER 1 1030 | | | | | PLAYER 2 1040 | | | | | PLAYER 3 1050 | | | | |
|---|---|---|---|---|---|---|---|---|---|---|---|---|---|---|---|
| | PLAYER ID 1031 | MACHINE ID 1032 | COIN IN 1033 | COIN OUT 1034 | NET TOTAL 1035 | PLAYER ID 1041 | MACHINE ID 1042 | COIN IN 1043 | COIN OUT 1044 | NET TOTAL 1045 | PLAYER ID 1051 | MACHINE ID 1052 | COIN IN 1053 | COIN OUT 1054 | NET TOTAL 1055 |
| 31157 | 2370493 | 123456 | 100 | 120 | +20 | 4599014 | 123457 | 100 | 98 | -2 | 3411190 | 123458 | 100 | 200 | +100 |
| 34156 | 4769066 | 234567 | 100 | 30 | -70 | 8790041 | 234568 | 100 | 150 | +50 | 9006544 | 234569 | 100 | 10 | -90 |

1005

1010

FIG. 10

1100

| | OUTCOME 1140 | SINGLE PLAYER 1150 | 2 MEMBER TEAM 1160 | 3 MEMBER TEAM 1170 |
|---|---|---|---|---|
| 1102 → | CHERRY/ANY/ANY | 2 | 1 | 1 |
| 1104 → | ANY/ANY/CHERRY | 2 | 1 | 1 |
| 1106 → | CHERRY/CHERRY/ANY | 5 | 3 | 1 |
| 1108 → | ANY/CHERRY/CHERRY | 5 | 3 | 1 |
| 1110 → | CHERRY/ANY/CHERRY | 5 | 3 | 2 |
| 1112 → | CHERRY/CHERRY/CHERRY | 20 | 10 | 5 |
| 1114 → | BAR/ORANGE/ORANGE | 10 | 5 | 2 |
| 1116 → | ORANGE/ORANGE/BAR | 10 | 5 | 2 |
| 1118 → | ORANGE/ORANGE/ORANGE | 20 | 10 | 5 |
| 1120 → | BAR/PLUM/PLUM | 14 | 6 | 3 |
| 1122 → | PLUM/PLUM/BAR | 14 | 6 | 3 |
| 1124 → | PLUM/PLUM/PLUM | 20 | 10 | 5 |
| 1126 → | BAR/BELL/BELL | 18 | 8 | 4 |
| 1128 → | BELL/BELL/BAR | 18 | 8 | 4 |
| 1130 → | BELL/BELL/BELL | 20 | 10 | 5 |
| 1132 → | BAR/BAR/BAR | 50 | 20 | 10 |
| 1134 → | 7/7/7 | 100 | 30 | 15 |

FIG. 11

1200

| | GAME RESULT 1240 | SINGLE PLAYER 1250 | 2 MEMBER TEAM 1260 | 3 MEMBER TEAM 1270 |
|---|---|---|---|---|
| 1202 | CHERRY/ANY/ANY | 2 | 2 | 2 |
| 1204 | ANY/ANY/CHERRY | 2 | 2 | 2 |
| 1206 | CHERRY/CHERRY/ANY | 5 | 4 | 3 |
| 1208 | ANY/CHERRY/CHERRY | 5 | 4 | 3 |
| 1210 | CHERRY/ANY/CHERRY | 5 | 4 | 3 |
| 1212 | CHERRY/CHERRY/CHERRY | 20 | 15 | 10 |
| 1214 | BAR/ORANGE/ORANGE | 10 | 7 | 5 |
| 1216 | ORANGE/ORANGE/BAR | 10 | 7 | 5 |
| 1218 | ORANGE/ORANGE/ORANGE | 20 | 15 | 10 |
| 1220 | BAR/PLUM/PLUM | 14 | 10 | 8 |
| 1222 | PLUM/PLUM/BAR | 14 | 10 | 8 |
| 1224 | PLUM/PLUM/PLUM | 20 | 15 | 10 |
| 1226 | BAR/BELL/BELL | 18 | 15 | 10 |
| 1228 | BELL/BELL/BAR | 18 | 15 | 10 |
| 1230 | BELL/BELL/BELL | 20 | 15 | 10 |
| 1232 | BAR/BAR/BAR | 50 | 30 | 20 |
| 1234 | 7/7/7 | 100 | 75 | 50 |

FIG. 12

1300

| | OUTCOME 1340 | SINGLE PLAYER 1350 | | | 2 MEMBER TEAM 1360 | | | 3 MEMBER TEAM 1370 | | |
|---|---|---|---|---|---|---|---|---|---|---|
| | | 1ST REEL 1351 | 2ND REEL 1352 | 3RD REEL 1353 | 1ST REEL 1361 | 2ND REEL 1362 | 3RD REEL 1363 | 1ST REEL 1371 | 2ND REEL 1372 | 3RD REEL 1373 |
| 1305 | CHERRY | 20 | 50 | 20 | 10 | 40 | 10 | 5 | 30 | 5 |
| 1310 | ORANGE | 20 | 30 | 70 | 10 | 30 | 85 | 5 | 20 | 90 |
| 1315 | PLUM | 50 | 10 | 100 | 65 | 10 | 110 | 70 | 10 | 115 |
| 1320 | BELL | 100 | 20 | 10 | 120 | 25 | 5 | 130 | 30 | 2 |
| 1325 | BAR | 20 | 100 | 10 | 10 | 110 | 5 | 5 | 115 | 2 |
| 1330 | 7 | 10 | 10 | 10 | 5 | 5 | 5 | 2 | 2 | 2 |

FIG. 13

1400

| | OUTCOME 1440 | SINGLE PLAYER 1450 | | 2 MEMBER TEAM 1460 | | 3 MEMBER TEAM 1470 | |
|---|---|---|---|---|---|---|---|
| | | RANDOM NUMBER 1452 | EXPECTED HITS PER CYCLE 1454 | RANDOM NUMBER 1462 | EXPECTED HITS PER CYCLE 1464 | RANDOM NUMBER 1472 | EXPECTED HITS PER CYCLE 1474 |
| 1402 | NONWINNING COMBINATION | 1-8570 | 8570 | 1-8917 | 8917 | 1-9289 | 9289 |
| 1404 | CHERRY/ANY/ANY | 8571-9250 | 680 | 8918-9467 | 550 | 9290-9789 | 500 |
| 1406 | ANY/ANY/CHERRY | 9251-9930 | 680 | 9468-10017 | 550 | 9790-10289 | 500 |
| 1408 | CHERRY/CHERRY/ANY | 9931-10130 | 200 | 10018-10167 | 150 | 10290-10389 | 100 |
| 1410 | ANY/CHERRY/CHERRY | 10131-10330 | 200 | 10168-10317 | 150 | 10390-10489 | 100 |
| 1412 | CHERRY/ANY/CHERRY | 10331-10398 | 68 | 10318-10367 | 50 | 10490-10524 | 35 |
| 1414 | CHERRY/CHERRY/CHERRY | 10399-10418 | 20 | 10368-104382 | 15 | 10525-10534 | 10 |
| 1416 | BAR/ORANGE/ORANGE | 10419-10460 | 42 | 10383-10412 | 30 | 10535-10554 | 20 |
| 1418 | ORANGE/ORANGE/BAR | 10461-10466 | 6 | 10413-10516 | 4 | 10555-10557 | 3 |
| 1420 | ORANGE/ORANGE/ORANGE | 10467-10508 | 42 | 10517-10546 | 30 | 10558-10577 | 20 |
| 1422 | BAR/PLUM/PLUM | 10509-10528 | 20 | 10547-10561 | 15 | 10578-10587 | 10 |
| 1424 | PLUM/PLUM/BAR | 10529-10533 | 5 | 10562-10565 | 4 | 10588-10590 | 3 |
| 1426 | PLUM/PLUM/PLUM | 10534-10583 | 50 | 10566-10600 | 35 | 10591-10615 | 25 |
| 1428 | BAR/BELL/BELL | 10584-10587 | 4 | 10601-10603 | 3 | 10616-10617 | 2 |
| 1430 | BELL/BELL/BAR | 10588-10607 | 20 | 10604-10618 | 15 | 10618-10627 | 10 |
| 1432 | BELL/BELL/BELL | 10608-10627 | 20 | 10619-10633 | 15 | 10628-10637 | 10 |
| 1434 | BAR/BAR/BAR | 10628-10647 | 20 | 10634-10647 | 15 | 10638-10647 | 10 |
| 1436 | 7/7/7 | 10648 | 1 | 10648 | 1 | 10648 | 1 |

FIG. 14

APPARATUS AND METHOD FOR FACILITATING TEAM PLAY OF SLOT MACHINES

CROSS-REFERENCE TO RELATED APPLICATIONS

This application is a continuation-in-part of U.S. patent application Ser. No. 09/590,021, incorporated herein by reference, filed on Jun. 8, 2000 now U.S. Pat. No. 6,361,941; which is a continuation of U.S. patent application Ser. No. 09/052,835, incorporated herein by reference, filed on Mar. 31, 1998 and issued as U.S. Pat. No. 6,142,872 on Nov. 7, 2000.

FIELD OF THE INVENTION

The present invention relates generally to electronic gaming devices, such as slot machines, and more particularly, to a system for facilitating team play of such electronic gaming devices.

BACKGROUND OF THE INVENTION

Gambling is a popular form of entertainment, offering gamblers many game alternatives, including numerous table games, such as poker, blackjack and roulette, and various electronic gaming devices, including slot machines, video poker devices, video keno devices and video blackjack devices (hereinafter, collectively referred to as "slot machines").

Golf is often played in a tournament environment where players compete against one another, with many golf tournaments incorporating a team component. The popular "better ball" golf tournament format, for example, permits the team score for each golf hole to be the lowest number of strokes obtained by any team player for a given hole. Another variation is the "best ball" format, where the best field position of any team player on each stroke is utilized by all team players for the subsequent stroke.

BRIEF DESCRIPTION OF THE DRAWINGS

FIG. 6 illustrates a sample table from the player database of FIG. 2;

FIG. 7 illustrates a sample table from the registered team database of FIG. 2;

FIG. 9 illustrates a sample table from the per-spin transaction database of FIG. 2;

FIG. 10 illustrates a sample table from the per-session transaction database of FIG. 2;

FIG. 11 illustrates a sample table from the per-spin payout database of FIG. 3;

FIG. 12 illustrates a sample table from the per-session payout database of FIG. 3;

FIG. 13 illustrates a sample table from the per-spin probability database of FIG. 3;

FIG. 14 illustrates a sample table from the per-session probability database of FIG. 3;

DETAILED DESCRIPTION

Figure 1:
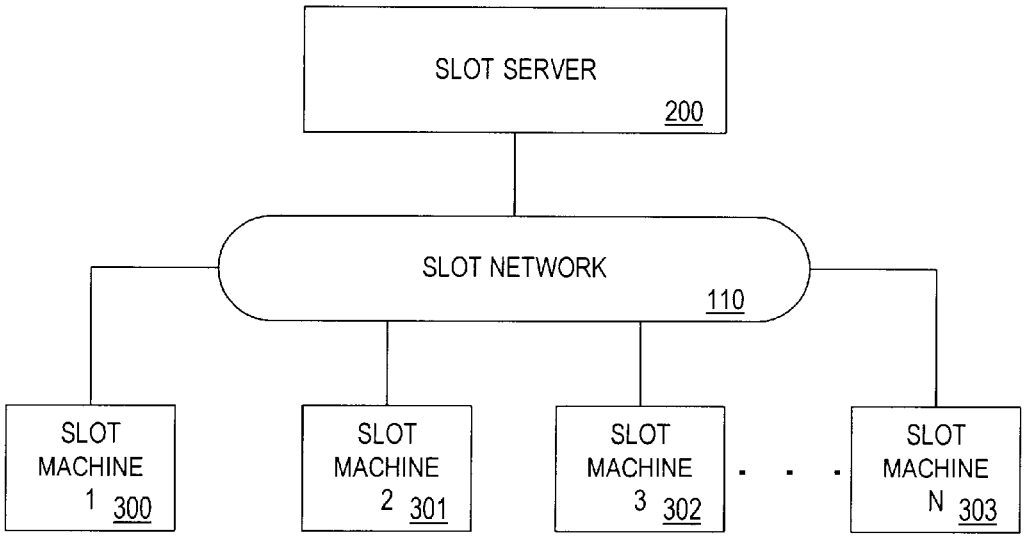
FIG. 1 is a schematic block diagram illustrating a suitable communications network environment for interconnecting one or more electronic gaming devices, such as slot machines, with a slot server.

There are many ways in which an individual team players' results, and/or a team game result, may be indicated. According to various embodiments of the present invention, a display indicates a team result by bringing to prominence relevant indicia from the individual team players' results. These relevant indicia form the team result. Indicia may include reel symbols, card symbols, or numbers (e.g., from a video keno game, a video bingo game, or a video roulette game). According to various embodiments of the present invention, a display at a slot machine may bring indicia to prominence through means such as highlighting, flashing, underlining, or enlargement of the indicia.

Generally, according to various embodiments of the invention, a plurality of slot machines and a slot server enable team play of the slot machines by a plurality of slot machine players. The game results of each player on a given team are combined in a predefined manner to obtain a team game result. The game results of each player may be combined on a "per-spin" basis, or the game results may be collected for each team player over an entire play session, with the net result of each team player combined on a "per-session" basis.

In a "per-spin" embodiment, each team player initiates play (on the same or separate slot machines), and the individual game results of each team player are used in a predefined manner to obtain a team game result, with the team game result being the one that provides the highest resulting payout, for each spin. The individual game results of each team player can be combined by selecting the symbol obtained by the team players in each reel position that provides the team game result with the highest resulting payout. Alternatively, the individual game result of the team player providing the highest resulting payout can be selected as the team game result. Alternatively, the team game result is not the highest resulting payout (e.g., is the second-highest resulting payout).

In a "per-session" embodiment, each team player continues play for an entire play session, and the net result of each team player is analyzed in a predefined manner on a "per-session" basis to obtain the team session result. A session can be defined, for example, in terms of (i) the number of plays per session; (ii) the duration of the session; or (iii) the number of plays until a predefined event occurs. The team session result can be defined, for example, as (i) the highest individual net result of a team player after an entire session; (ii) the average of the net result of each team player after an entire session; (iii) the sum of the highest five payouts awarded to any team player during the session; or (iv) the sum of each of the highest payouts for each spin. Alternatively, the team session result is not a highest resulting payout (e.g., is the second-highest resulting payout). Also, the team session result need not be based on a highest payout (or payouts). For example, the team session result can be defined as (i) the second highest individual net result of a team player after an entire session; or (ii) the sum of any predetermined combination of payouts awarded to any team player during the session (or for each spin).

FIG. 1 shows an illustrative slot network 110 for transferring information between one or more slot machines 300–303 and a slot server 200. According to a feature of the present invention, the slot server 200 permits team play of slot machines by a plurality of slot machine players using the slot machines 300–303. The game results of each player on a given team are combined in a predefined manner, and the overall game result (e.g., one that provides the highest payout) is provided to each of the team members.

According to a further feature of the invention, the game results of each player on a given team may be combined in a predefined manner on a "per-spin" basis. The game results may also be collected for each team player over an entire play session, with the net result of each team player analyzed in a predefined manner on a "per-session" basis. In this manner, team players are encouraged to support and cheer on one another and may compete against other teams. Thus, according to these and other various embodiments of the present invention, the social and competitive aspects of slot machine play may be increased. In addition, the potential loss to each team player is minimized, since a non-winning per-spin or per-session game result by a team player can be offset when combined with the corresponding winning results of another team member.

As used herein, the term "slot machine" refers to any programmable gaming device generating a random or pseudo-random event in which one or more players can wager on the outcome of the event. Examples of slot machines include traditional slot machines, video poker, video bingo, video keno and video blackjack devices.

Team Registration

Teams may be formed by individual slot machine players or by a casino, for example, on an anonymous ad hoc basis. Players can optionally register for team play with a casino, for example, by providing the names and player tracking numbers of team players and the preferences of the team, such as whether per-spin or per-session team play is preferred, and the preferred length of each session for per-session play. Team players can be linked electronically, for example, by means of player tracking cards. Thus, the slot server 200 can recognize players as members of a team once the player tracking card of each team member has been inserted into a card reader on the slot machine 300–303. The presence of all team members may or may not be required to initiate team play. Slot server 200 can indicate to a team player whether other team members are currently playing a slot machine 300–303, such as a representative slot machine 300, in the casino.

The formation of a team may begin when one or more of the prospective members communicates to the slot server 200 the desire to form a team. Team members may communicate with the slot server 200 via a gaming device, such as slot machine 300, with a network connection to the server. Team members may come to an information or chip-cashing desk at a casino and inform a casino employee of the desire to register a team. The casino employee may then communicate with the slot server 200 on the team's behalf. A team may also register on-line. For example, one or more team members may use a personal computer to access a Web site hosted by a slot server 200. The team member(s) may then provide registration information by keying it into dialog boxes on the Web site, by selecting relevant options from menus, and so on. A team may also register over the phone, via email, or via any other method, such as a form displayed at a display of a slot machine 300, or on a Web page hosted by the slot server 200.

A casino may prompt prospective team members as to whether or not they wish to join a team. For example, a slot server 200 may transmit a message via the casino's slot network to prospective members' slot machines. A slot machine 300 that has received such a message may then display it on a display of the slot machine 300. Alternatively, the slot machine 300 may output an audio message to the user at the slot machine 300. The user may then respond by touching areas on a display, by keying in a response using a keypad or other buttons, or by voicing a response into a microphone of the slot machine 300.

Per-Spin Embodiment

Generally, in a "per-spin" embodiment of the present invention, each team player initiates play in a conventional manner, and the individual game results of each team player are combined in a predefined manner to obtain the team game result, with the team game result being the one that provides the highest resulting payout, for each spin. In the illustrative implementation of the per-spin embodiment discussed herein, the individual game results of each team player are combined by selecting the symbol obtained by the team players in each reel position that provides the team game result with the highest resulting payout. In an alternate implementation, the individual game result of the team player providing the highest resulting payout can be selected as the team game result.

For example, three team players, Jack, Mary and Bob commence per-spin team play on three of compatible slot machines 300–303, such as three-reel slot machines. Once the team players initiate play at their respective slot machines, the following individual game results and team game result may occur (assuming the team game result is obtained by selecting one symbol from each reel position that provides the best team game result):

| | REEL 1 | REEL 2 | REEL 3 | CORRESPONDING PAYOUT FOR CONVENTIONAL VERSUS TEAM RESULTS |
|---|---|---|---|---|
| JACK | BELL | ORANGE | BELL | 0 |
| MARY | CHERRY | BAR | CHERRY | 5 COINS |
| BOB | BAR | CHERRY | BELL | 0 |
| TEAM GAME RESULT | CHERRY | CHERRY | CHERRY | 5 COINS PER TEAM PLAYER |

If each of the team players in the above example had been playing on conventional slot machines, only Mary would have been a winner of five coins. As per-spin team players, however, each of the team players is awarded five coins for the "best team game result" of "cherry/cherry/cherry," based on the payout awards provided in the per-spin payout database 1100, discussed further below in conjunction with FIG. 11. As discussed further below, in conjunction with FIGS. 3, 4A and 4B, in the per-spin embodiment, the slot machine 300 may optionally include a display indicating the individual game result of each team player after each spin of the slot machine 300, as well as the combined team game result. In this manner, the interactive aspects of team play are reinforced to team players, and team players can ensure that the best team game result has been selected for each spin.

In one implementation of the per-spin embodiment, each team player must wait for all other players on the same team to complete their spin before obtaining the team game result. A "waiting" message can be presented next to the names of the team players that have not completed their spin. In a further variation, individual team players can continue individual play while waiting for the team results.

Per-Session Embodiment

Generally, in a "per-session" embodiment of the present invention, each team player continues play in a conventional manner for an entire play session, and then the net result of each team player can be analyzed in a predefined manner on a "per-session" basis to obtain the team session result. A session can be defined, for example, in terms of (i) the number of plays per session, such as 100 plays of the slot machine; (ii) the duration of the session, such as one hour; or (iii) the number of plays until a predefined event occurs, such as a particular game result (e.g., one team player hits "cherry/cherry/cherry").

As discussed further below, the slot server 200 monitors the game results of each team player for the duration of the session, and then awards the team session result to each team player after the session is complete. In the illustrative implementation of the per-session embodiment discussed herein, the highest individual net result of a team player after an entire session is selected as the team session result. In alternate implementations, the team session result can be defined as (i) the average of the net result of each team player after an entire session; (ii) the sum of the highest five (or highest x, where x could be any number) payouts awarded to any team player during the session; (iii) the sum of each of the highest payouts for each spin; or (iv) the sum of all payouts for a given game result, such as a predefined game result, the most frequently occurring game result, the game result providing the highest payout over an entire session, or the game result providing the lowest positive payout; (v) the sum of each team player's highest three (or highest x) payouts; (vi) the sum of net results of each team at the point in time during the session when the sum was the highest; (vii) the average of the net results of the single best performing team player and the single worst performing team player; (viii) the negative of any of the above, e.g. the negative of the average net results each team player; or (ix) the sum of the first, third, and fifth highest payouts for each spin.

For example, three team players, Jack, Mary and Bob commence per-session team play on three of compatible slot machines 300–303, such as three-reel slot machines, and continue for an entire session of 100 plays. A compatible slot machine may be defined, for example, as a slot machine having the same manufacturer and model number. Once each of the team players completes the session at their respective slot machines, the following individual net results and team session result may occur (assuming the team session result is obtained by selecting the highest individual net result):

| | PLAYER WIN/LOSS |
|---|---|
| JACK | +20 |
| MARY | −2 |
| BOB | +100 |
| TEAM SESSION RESULT | +100 |

Once the session is complete, the slot server 200 determines that the highest individual net result is +100. Since each player inserted 100 coins to complete the 100 play session, the slot server 200 then instructs the respective slot machines to dispense 200 coins to each team player to obtain the desired team session result of 100 coins (a profit of 100 coins for each player). If each of the individual team members obtains a negative net result, the slot server 200 selects the best negative net result as the team session result and instructs the respective slot machines to dispense the appropriate amount of coins to each team player that results in each player obtaining a minimum loss equal to the team session result. Thus, according to this and other various embodiments of the present invention, the financial risk associated with slot machine play may be spread among a plurality of players.

As discussed further below, in conjunction with FIGS. 3, 5A, 5B, 5C and 5D, in the per-session embodiment, the slot machine 300 may optionally include a display indicating the current net result of each team player, as well as the current team session result. In this manner, the interactive aspects of team play are reinforced to team players and team players can ensure that the correct team session result has been selected for the session. Alternatively, the individual net results and team session results may be displayed only upon completion of a session.

In one implementation of the per-session embodiment, each team player could be required to play a session simultaneously. In an alternate implementation, team players could play at separate times, and the team session result can be calculated once each team player has completed the session. A "waiting" message can be presented next to the names of the team players that have not completed their session. Preferably, no coins are paid out until the session is complete.

The slot server 200 and the slot machines 300–303, discussed further below in conjunction with FIGS. 2 and 3, respectively, may be embodied as conventional hardware and software, as modified herein to carry out the functions and operations described below. The slot server 200 and slot machines 300–303 transmit data between one another. The transmitted data may represent player names and corresponding identification numbers and team associations, credit balance amounts and play results. Of course, other types of data may also be transmitted. The slot server 200 and each of the slot machines 300–303 may communicate by means of cable and/or wireless links on which data signals can propagate.

Figure 2:
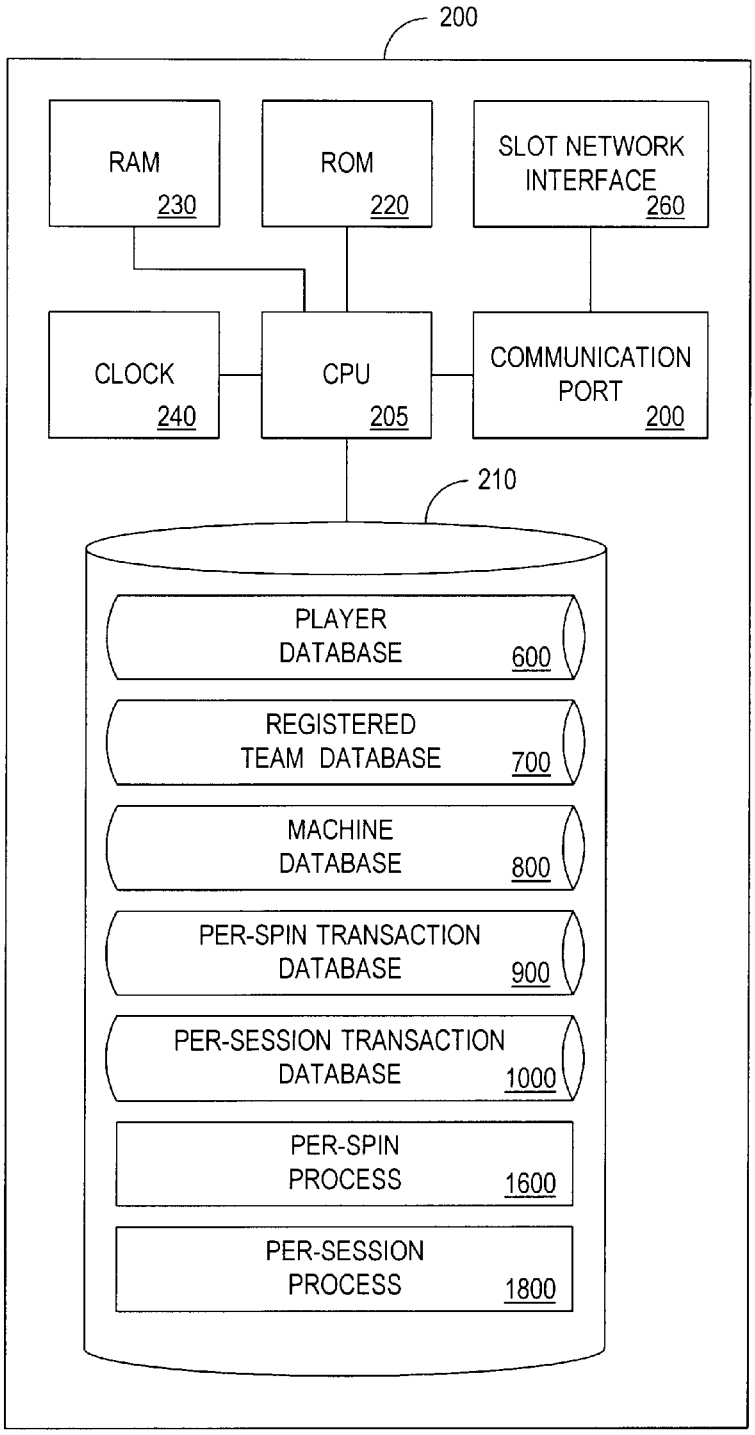
FIG. 2 is a schematic block diagram of the slot server of FIG. 1.

FIG. 2 is a block diagram showing the architecture of an illustrative slot server 200. The slot server 200 may be embodied, for example, as an RS 6000 server, manufactured by IBM Corp., as modified herein to execute the functions and operations of the present invention. The slot server 200 includes known hardware components, such as a central processing unit (CPU) 205 in communication with each of a data storage device 210, a read only memory (ROM) 220, a random access memory (RAM) 230, a clock 240, a communications port 250 and a slot network interface 260. The CPU 205 can be in communication with the data storage device 210, the read only memory (ROM) 220, the random access memory (RAM) 230, the clock 240, the communications port 250 and the slot network interface 260, either by means of a shared data bus, or dedicated connections, as shown in FIG. 2. The CPU 205 may be embodied as a single processor, or a number of processors.

As discussed further below in conjunction with FIGS. 6 through 10, the data storage device 210 includes a player database 600, a registered team database 700, a machine database 800, a per-spin transaction database 900 and a per-session transaction database 1000. The player database 600 stores information on each player, including an identifier of each player's team and the player's loyalty reward points balance. According to various embodiments, a player may be on more than one team. Player database 600 may thus include an identifier for each team of which the player is a member. The registered team database 700 stores information on each team that is registered for slot machine play, including an identification of each team member. The machine database 800 stores information on each slot machine in a casino, including the type of each machine. The stored machine information may be used, for example, to ensure that each team player is utilizing one of compatible slot machines 300–303. The per-spin transaction database 900 stores play results for each team playing in a per-spin embodiment of the present invention. The per-session transaction database 1000 stores play results for each team playing in a per-session embodiment of the present invention.

The data storage device 210 and/or ROM 220 are operable to store one or more instructions, which the CPU 205 is operable to retrieve, interpret and execute. As shown in FIG. 2 and discussed further below in conjunction with FIGS. 16 and 18, the data storage device 210 includes a per-spin process 1600 and a per-session process 1800, to implement the two illustrative embodiments of the present invention. As discussed below, the per-spin process 1600 and the per-session process 1800 are each executed in cooperation with similar processes 1500, 1700, respectively. These processes 1500, 1700 are executed on the individual slot machines 300–303 being utilized by team members.

The communications port 250 connects the slot server 200 to a slot machine interface 260, thereby permitting the slot server 200 to communicate with each connected slot machine, such as the slot machines 300–303 shown in FIG. 1. The communication port 250 may include multiple communication channels for simultaneous connections. It is noted that the functionality provided by the slot server 200, such as providing each slot machine 300–303 with team information and coordinating team play, could be provided directly by one or more of the slot machines 300–303 or by a separate team controller (not shown), as would be apparent to a person of ordinary skill in the art.

Figure 3:
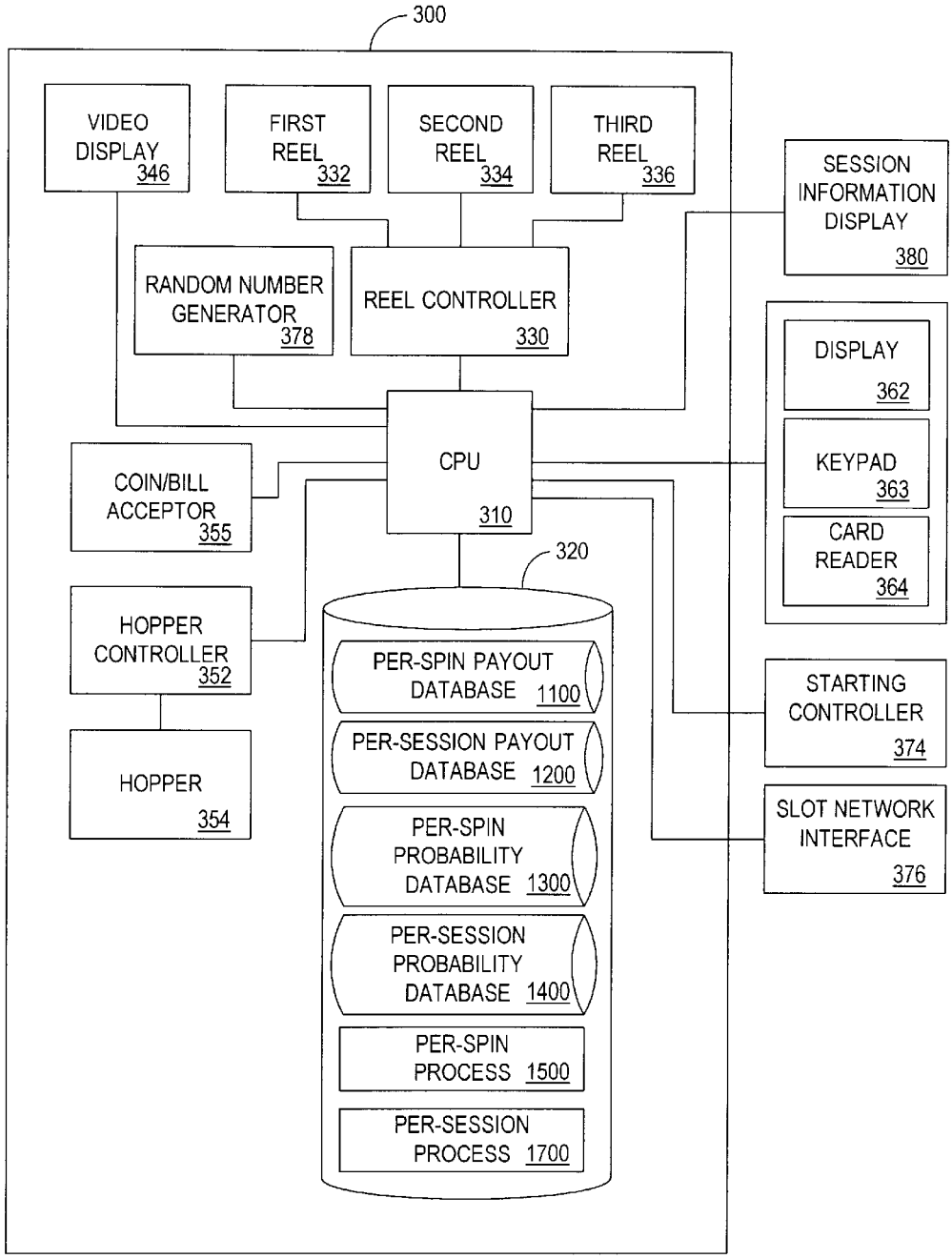
FIG. 3 is a schematic block diagram of a slot machine of FIG. 1, in accordance with the present invention.

FIG. 3 is a block diagram showing the architecture of an illustrative slot machine 300. Although descriptions herein of various embodiments of the present invention may refer for convenience to slot machine 300, it will be understood that such descriptions may apply to any of slot machines 300–303. The architecture illustrated in FIG. 3 is also descriptive of the functionality of the slot machines 301–303 shown in FIG. 1. Plan views of various per-spin and per-session embodiments of the slot machine 300 are shown in FIGS. 4A, 4B, 5A, 5B, 5C and 5D. The slot machine 300 includes known hardware components, such as a CPU 310 and a data storage device 320, which may function in a similar manner to those corresponding components described above in conjunction with FIG. 2.

As previously indicated, the present invention permits team play of slot machines on a "per-spin" or "per-session" basis. In one implementation, each slot machine 300 maintains separate databases for storing the probability that a given game result will occur, and the corresponding payout associated with each winning game result, for a number of team sizes, for each of the "per-spin" and "per-session" embodiments. Thus, as discussed further below in conjunction with FIGS. 11 through 14, respectively, the data storage device 320 includes a per-spin payout database 1100, a per-session payout database 1200, a per-spin probability database 1300 and a per-session probability database 1400. Generally, the per-spin payout database 1100 and the per-session payout database 1200 store the payouts associated with each winning game result for a number of team sizes, for the per-spin and per-session embodiments, respectively.

Likewise, the per-spin probability database 1300 and the per-session probability database 1400 store the probability that a given game result will occur for a number of team sizes, for the per-spin and per-session embodiments, respectively. The respective payout databases 1100, 1200 or the probability databases 1300, 1400, for each of the "per-spin" and "per-session" embodiments, can be adjusted in accordance with the present invention to fund team play. Alternatively, both the respective payout databases 1100, 1200 and the probability databases 1300, 1400, for each of the "per-spin" and "per-session" embodiments, can be adjusted to fund team play. For a more detailed discussion of a conventional slot machine, and the associated probabilities and payouts, see J. Regan, Winning at Slot Machines (Citadel Press 1985), incorporated by reference herein.

In addition, the data storage device 320 and/or ROM (not shown) are operable to store one or more instructions, which the CPU 310 is operable to retrieve, interpret and execute. As shown in FIG. 3 and discussed further below in conjunction with FIGS. 15 and 17, the data storage device 320 includes a per-spin process 1500 and a per-session process 1700, to implement the "per-spin" and "per-session" embodiments of the present invention. As previously indicated, the per-spin process 1500 and the per-session process 1700 are executed by the slot machines 300–303 being utilized by team players, in cooperation with similar processes 1600, 1800, respectively, executing on the slot server 200 to coordinate team play.

In a per-spin embodiment, each player starts the representative slot machine 300 in a conventional manner by providing a form of payment, for example, by depositing one or more coins or bills in a coin/bill acceptor 355, or inserting a credit card, debit card or smart card into a card reader 364. If the player inserts a player tracking card, the slot machine 300 will determine if the player is registered with a team. Alternatively, a player may indicate he is registered with a team by other means, such as via a button or keyboard input. If the player is not registered with a team, the player can play the slot machine 300 in a conventional manner.

If the player is registered with a team, however, and agrees to participate in team play while one or more of the player's teammates are currently playing, team play can be enabled. Each team player then initiates play by pressing a starting controller 374, such as a "spin reels" button on their respective slot machine 300–303. Thereafter, the CPU 310 on each respective slot machine 300–303 initiates the random number generator 378 to generate a random number. The CPU 310 looks up the generated random number in the appropriate field of the appropriate probability database per-spin probability database 1300, discussed below in conjunction with FIG. 13, and based on the number of team players currently playing retrieves the corresponding reel combination, or individual game result. Each CPU 310 also directs a reel controller 330 to spin the reels 332, 334, 336 and to stop them at a point when a combination of symbols corresponding to the retrieved individual game result is displayed. In alternative embodiments, the slot machine 300 does not include the reel controller 330, or reels 332, 334, 336. Instead, a video display area 346 graphically displays representations of objects contained in the selected game, such as graphical reels or playing cards. These representations are preferably animated to simulate playing of the selected game.

Figure 4A:
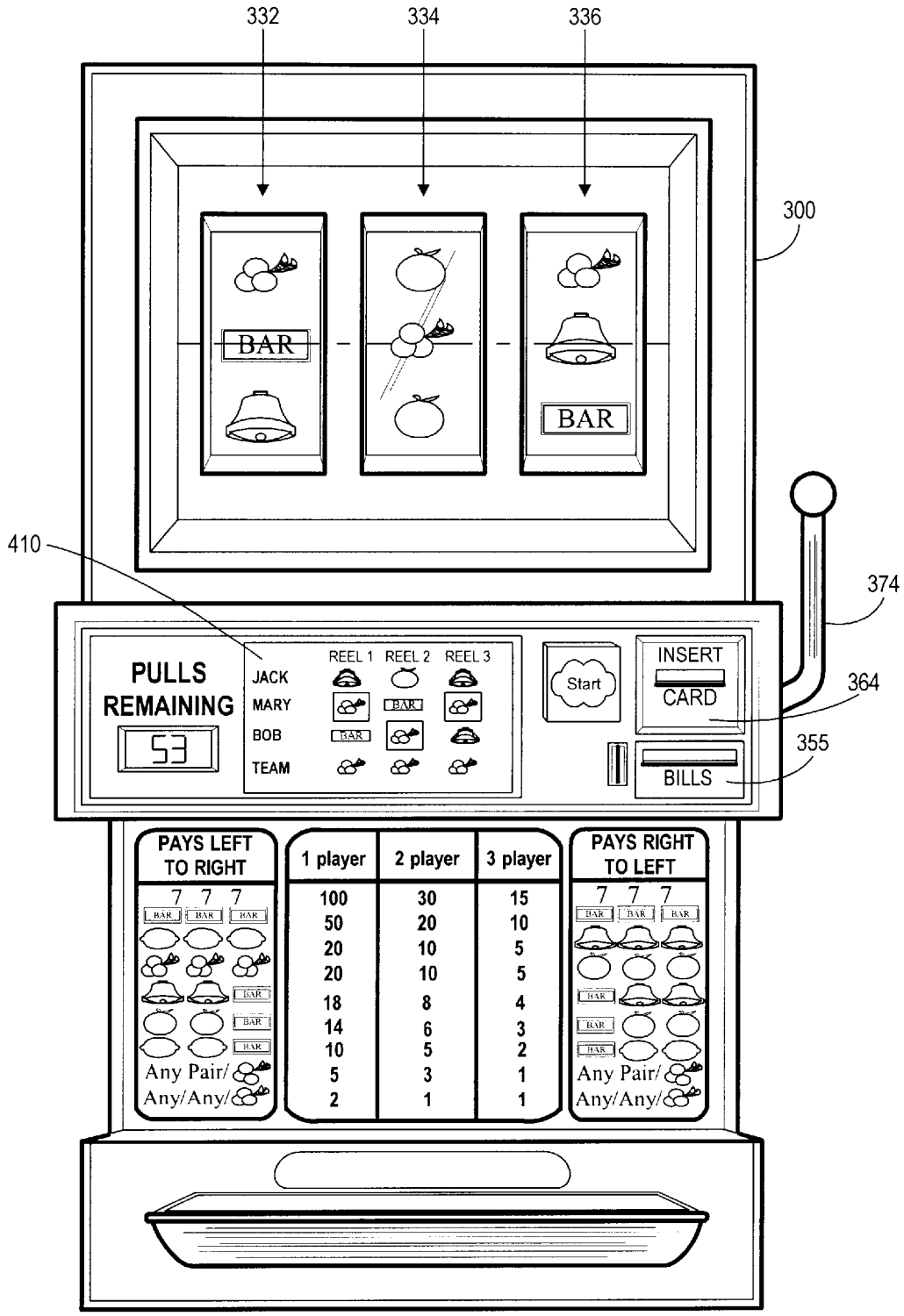
FIGS. 4A, 4B, 5A, 5B, 5C and 5D are plan views of various embodiments of the slot machine of FIG. 3.

The individual game result of each team player is then transmitted to the slot server 200, which generates the resulting team game result in a predefined manner. The slot server 200 then transmits the individual game results and resulting team session result to each slot machine 300–303, for display to each team player on a display. According to various embodiments of the present invention, slot machine 300 brings to prominence indicia from individual team players' results by displaying the indicia in an area of video display 346 of slot machine 300. Alternatively, as described with respect to various embodiments herein, indicia and/or results may be displayed at a display of slot machine 300 other than video display 346, such as display 410 (FIG. 4A).

There are many ways in which a display may indicate individual team players' results and/or the team game result. In one embodiment, a display of slot machine 300 indicates the team result by bringing to prominence relevant indicia from the individual team players' results. These relevant indicia are combined in a predefined manner to form the team result. Indicia may include reel symbols, such as "orange", "cherry" or "7". Indicia may also include card symbols, such the king of spades, three of diamonds, or a joker. Indicia may further include numbers from a video keno game, a video bingo game, or a video roulette game.

In another embodiment, a slot machine 300 brings to prominence indicia from individual team players' results by displaying the indicia at a display of the slot machine 300. A display (e.g., video display area 346) of slot machine 300 may highlight, call attention to, or otherwise bring indicia to prominence through the use of highlighting, flashing, underlining, enlargement, or other means known to those of skill in the art.

For example, suppose Linda and Sue comprise a two-person team. In one example of a video poker embodiment, Linda and Sue are on separate video draw poker machines. Each begins with a five-card hand, discards from one to five cards, and receives replacement cards. The team result for Linda and Sue may be defined, for example, as the best five-card poker hand that can be made by combining at least one card from Linda's hand with at least one card from Sue's hand. Of course, the team result may be defined as various other combinations of Linda's hand and Sue's hand. For example, a team result need not require at least one card from each player's hand.

Once Linda and Sue have each completed individual games, the slot server 200 receives Sue's individual game result and transmits it to Linda's slot machine, and receives Linda's individual game result and transmits it to Sue's slot machine. Then, Linda's slot machine displays Linda's five-card hand in one row, and Sue's five-card hand in a second row. The slot machine then highlights the five cards from the two hands that will make the team result. For instance if Linda's hand is As Qs 9d 5h 3c, and Sue's hand is Ks Js 10s 8c 6c (where "A"=ace, "K"=king, "Q"=queen, "J"=jack, "s"=spades, "h"=hearts, "d"=diamonds, "c"=clubs) then the As Qs from Linda's hand combines with the Ks Js 10s from Sue's hand to make a team outcome of As Ks Qs Js 10s, or a royal-straight-flush. In this example, Linda's slot machine may therefore highlight the As and Qs from Linda's hand, and the Ks Js 10s from Sue's hand, so as to indicate the cards that are to be used in the team result.

FIG. 4A illustrates another example of bringing to prominence individual indicia from different team players' results so as to indicate a team result. In FIG. 4A, outcomes for three team players are displayed at display 410. Team player Jack has obtained the outcome bell-orange-bell. Team player Mary has obtained the outcome cherry-bar-cherry. Team player Bob has obtained the outcome bar-cherry-bell. In FIG. 4A at display 410, a line is drawn around each of the cherry indicia, forming a separate box around each cherry indicium. In this way, each team player can see that the two cherries from Mary's outcome, and the cherry from Bob's outcome, have contributed to the overall team outcome of cherry—cherry—cherry. Of course, alternatively or in addition, the indicia and results could be displayed at video display 346.

A display (e.g., display 410) on a slot machine 300 may also rearrange indicia in order to indicate a team result. For instance, in the above example, Linda's slot machine may initially display Linda and Sue's individual results as hands in two separate rows. The display 410 may then show the cards being switched between the two rows until the team result is in the top row, and the cards not used from Linda and Sue's hands are displayed in the bottom row. In many embodiments, the rearrangement is performed slowly so that a user can easily see a card from one row traveling to the other, and being replaced by another card from the other row. Furthermore, the slot machine may repeatedly illustrate the rearrangement of cards, in case the user had not been paying attention. For example, display 410 may begin by showing Linda's hand in row one and Sue's hand in row two, and may then rearrange the cards to show As Ks Qs Js 10s in row one and 9d 5h 3c 8c 6c in row two. However, slot machine 300 may then revert to showing Linda's hand in row one and Sue's hand in row two, and repeat the rearrangement. The process may repeat until, for example, Linda and Sue begin a new game. Of course, a slot machine 300 may illustrate the rearrangement of any other type of indicia between two or more individual results in order to display a team result.

In another embodiment, a slot machine 300 brings to prominence indicia from individual team players' results by displaying the indicia in a special area on a video display of the slot machine 300 (e.g., video display 346), or other display. Once again using the example of Linda and Sue, Linda's slot machine may display both Linda and Sue's individual results on the lower part of the screen. However, in the upper half of the screen, Linda's slot machine may display the team result consisting of only the five cards As Ks Qs Js 10s. With these five cards at the top of Linda's video display, the same cards may or may not be removed or blanked out from Linda and Sue's hands displayed at the bottom. In some embodiments, Linda and Sue's individual results are first displayed at the bottom of the slot machine. From there, the display shows the individual cards to be displayed moving upwards towards the top of the screen where they are arranged into the team result. The cards that move to the top may be the originals that thereupon leave Linda and Sue's individual results.

Alternatively, the cards moving to the top of the display may be duplicates, or may otherwise represent the cards from the individual results that are being used to form a team result. For example, the cards in motion may be duplicates, or faded, highlighted, flashing, alternatively-colored, differently-sized, or differently-shaped representations of the indicia from the individual results. For example, a card Ks in an individual result may be represented by a chess piece, advancing to the top of the screen, and bearing the marks of a Ks. The motion of cards or other indicia, from a display of individual results to a display of a team result, makes it clear to a team player how a team result is formed from individual results.

Figure 4B:
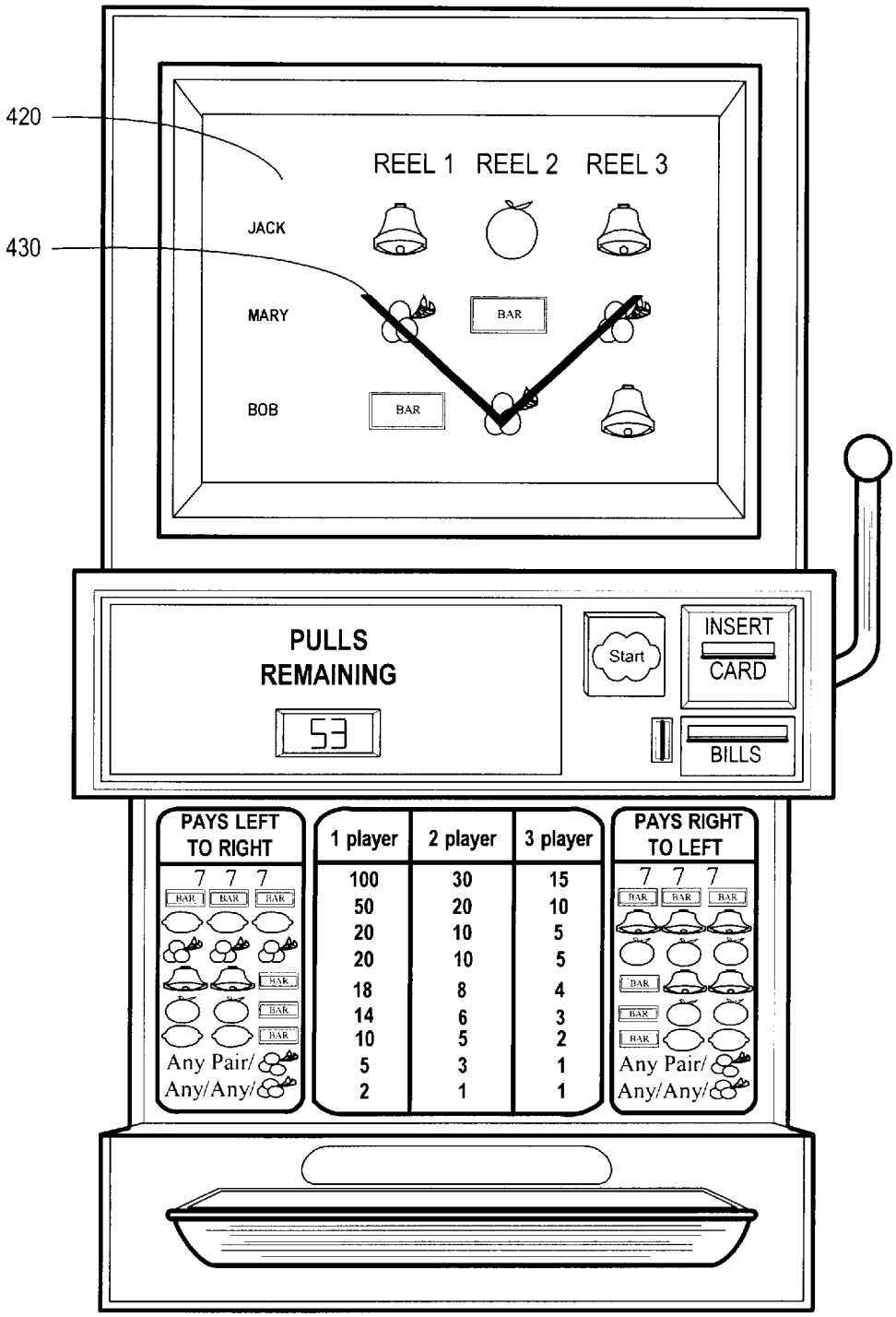

In another embodiment, a slot machine 300 displays multiple results from individual team players in proximity to one another. For example, the team of Jack, Mary, and Bob, obtain the outcomes of bell-orange-bell, cherry-bar-cherry, and bar-cherry-bell, respectively. When the three individual results are combined into a team result, the three outcomes are displayed right above one another, as illustrated in FIG. 4B at display 420. A line 430 is drawn through the indicia that are to form the team result. So, for example, the line 430 is drawn going through the first cherry of Mary's outcome, continuing through the cherry of Bob's outcome, and continuing through the second cherry of Mary's outcome. It is therefore evident to the team players that the three indicia through which the line is drawn comprise the team outcome of cherry—cherry—cherry. Other means of showing the grouping of indicia from different team players' outcomes are also possible. For example, a line may be drawn that encircles only the two cherries from Mary's outcome and the cherry from Bob's outcome.

In one embodiment, the slot machine uses a puzzle metaphor to show how different player outcomes combine to form a team outcome. After each team player's individual outcome has been generated, and the slot server 200, or one of the slot machines 300–303, has determined the team outcome, then a team player's slot machine 300 may begin by displaying the team outcome in faded color(s). For instance, the slot machine 300 may display the team outcome of bell—bell—bell by showing three bell indicia in faded colors. Then, the slot machine 300 shows a bell indicium being taken from a team player's outcome and being overlaid on top of one of the faded bells. Then another bell indicium from a team player's outcome is taken and overlaid on top of another of the faded bells. In this manner, players can visually see what the team outcome is going to look like, and can see how pieces of the "puzzle" are taken from individual team players' outcomes and put in place to form the team outcome.

In other puzzle embodiments, individual indicium take the form of shapes or structures. A team outcome can be displayed from among individual team player indicia by showing such indicia coming together in such a way as to complement each other in shape or structure. For example, one team player obtains an indicium in the shape of an incomplete circle (e.g., with a wedge-shaped space in the circle, or with a break in the circumference of the circle). Another player obtains an indicium having a complementary shape (e.g., the shape of the wedge-shaped space). The team result is formed by combining the indicia of the players (e.g., aligning the incomplete circle and the wedge) into a complete circle.

In some embodiments, the combination of game results from different team players may result in outcomes that are not attainable by a player on his own. For example, two hands of video poker, one containing three aces, and one containing two aces, may be combined to form a hand with five aces. It would be impossible for a player using a single ordinary deck to achieve a hand with five aces. Another hand of video poker attainable through the combination of individual hands, but not in an individual hand, would be a two-pair/flush. A team may receive bonus payouts for achieving combinations not attainable by an individual player or by individual team members.

Based on the identified team result, each slot machine 300–303 stores the payout credits, if any, in a random access memory (RAM) (not shown). A hopper controller 352 is connected to a hopper 354 for dispensing coins. Each team player can cash out in a conventional manner by pushing a cash out button 370 on his or her respective slot machine 300–303. The CPU 310 then checks the RAM to see if the player has any credit and, if so, signals the hopper 354 to release an appropriate number of coins into a payout tray (not shown).

In a per-session embodiment, each team player starts his or her representative slot machine 300–303 in a conventional manner. If a player inserts a player tracking card, the slot machine 300 will determine if the player is registered with a team. If the player is not registered with a team, the player can play the slot machine 300 in a conventional manner. If the player is registered with a team, however, and agrees to participate in team play while one or more of the player's teammates are currently playing, each team player continues play in a conventional manner for an entire play session, in the manner described above. Once the session is complete, each slot machine 300–303 being utilized by a team player can signal the slot server 200 with each player's net result. The slot server 200 combines the net result of each team player in a predefined manner on a "per-session" basis to obtain a team session result.

Figure 5A:
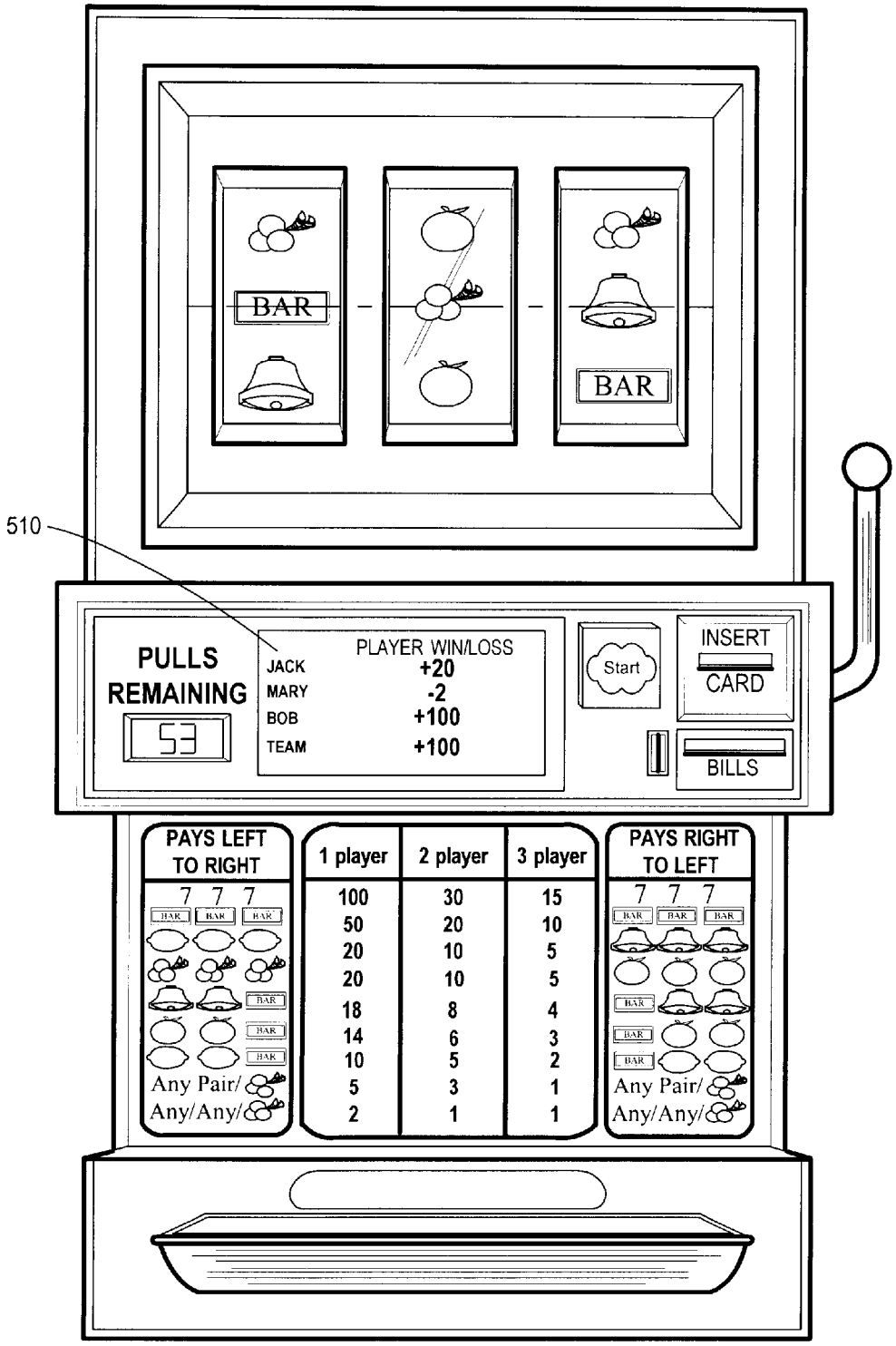

The slot server 200 then transmits the individual net results of each team player and the resulting team session result to each slot machine 300–303, for display to each team player on a display. According to various embodiments of the present invention, the individual net results of each team player and the team session result may be displayed in an area of video display 346 of slot machine 300. Alternatively, as described with respect to various embodiments herein, player and/or team results may be displayed at a display of slot machine 300 other than video display 346, such as display 510 (FIG. 5A).

In many embodiments described herein, the highest result among team players' individual results becomes the team result. For example, the highest payout among the team players on a given spin becomes the team result. The individual player results may thus be appropriately illustrated graphically so as to make it visually evident which team player has obtained the highest result. For example, each team player's name is listed horizontally along the axis of a bar graph. The bar corresponding to each player's name then illustrates the payout for the outcome achieved by that player for the current spin. By looking at the bar graph, it becomes evident which player has achieved the highest payout, because the bar corresponding to that player extends above all of the other bars. In some embodiments, once all team players' individual results have been graphically illustrated on the bar graph, the name and/or the bar of the player who has achieved the highest payout on the spin is made prominent, so that it is even more clear which player's individual result has become the team result. A bar graph may further be used to illustrate individual team players' net or gross session results.

In some embodiments, sorting is used to illustrate a team result that is the highest from among individual player results. For instance, the names of three team players are listed in a column on a display of a slot machine 300. Once each team player has made his spin, the payout for each team player's outcome is posted next to the corresponding team player's name. Then, the team players' names are rearranged in the column on the screen, so that the name of the team player with the highest payout is now at the top of the column.

Figure 5B:
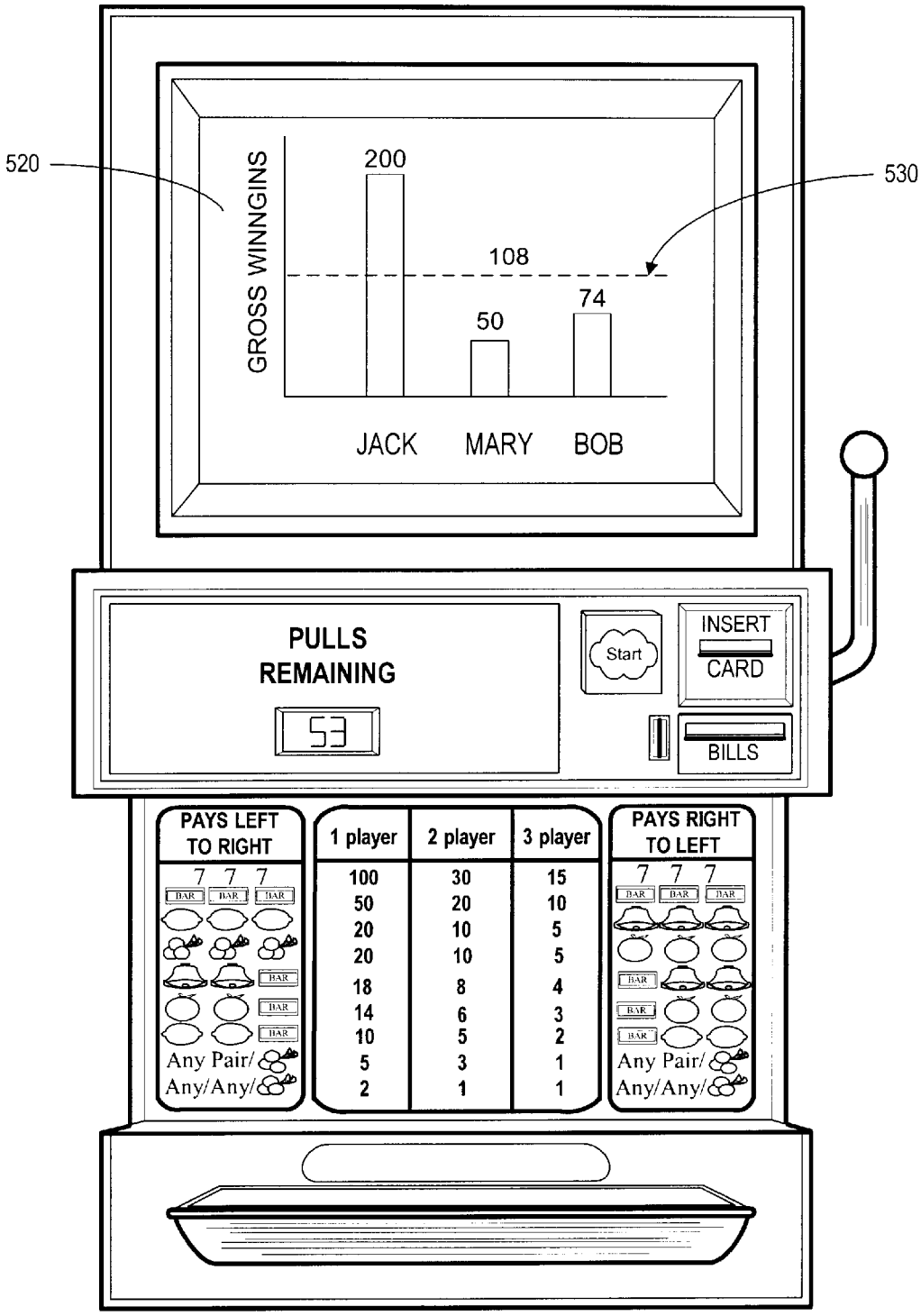
Figure 5C:
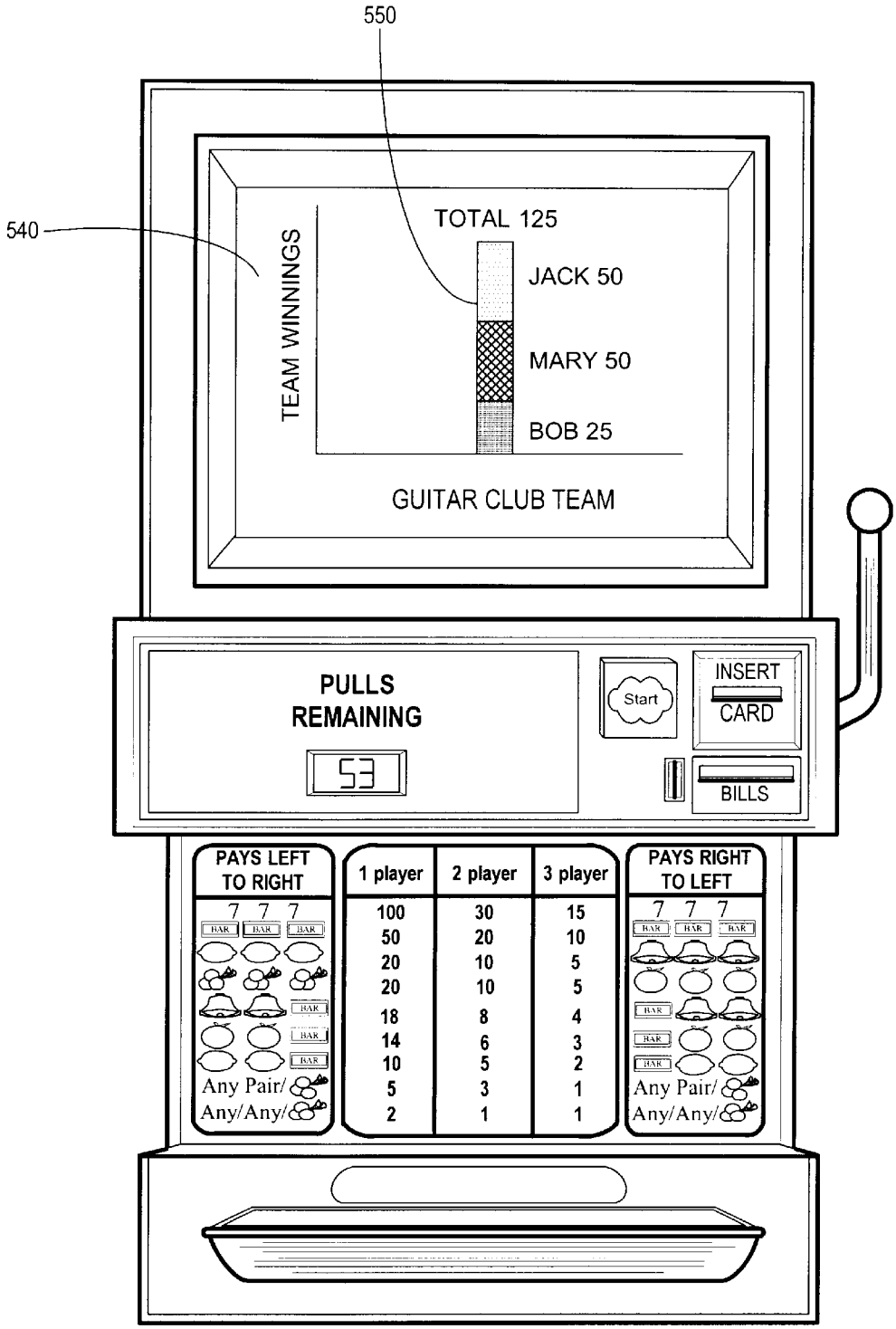
Figure 5D:
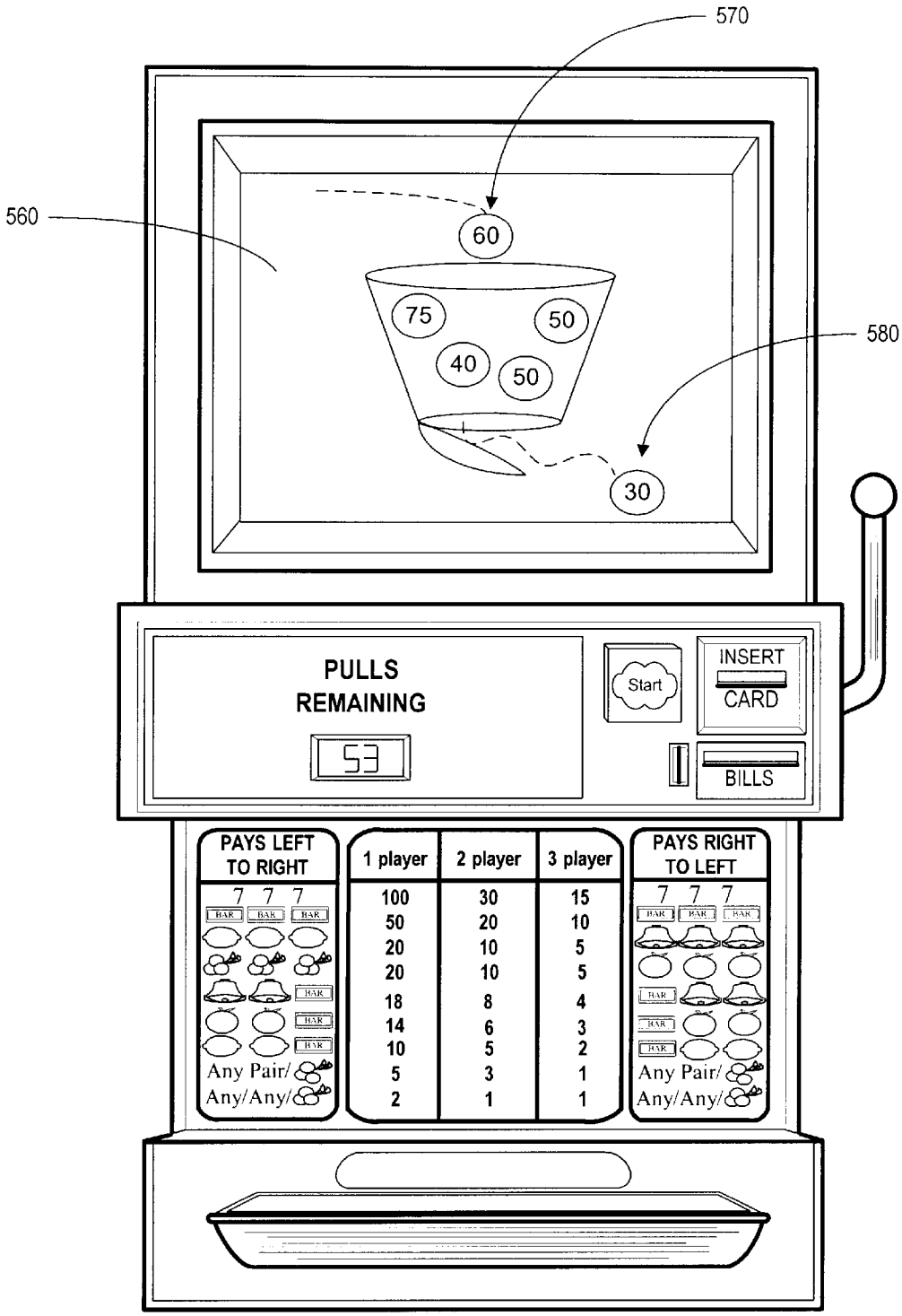

Graphs may also be useful for depicting team results that are averages of the results of individual team players. For instance, the gross winnings for each team member are illustrated using a bar graph. An exemplary bar graph is depicted in FIG. 5B at display 520. Then, a horizontal line 530 is drawn across the graph to show the average gross winnings for all team players. A player who sees the line 530 will notice that the line 530 is below some of the better team player results, while it is above some of the worse team player results. It will thus make sense to the team players that the individual team players' results are being averaged to achieve the team result.

Various embodiments of the present invention derive a team result from the sum of individual players' results. For example, a team result may be the sum of the highest three payouts awarded to any team player during a session. A sum of individual player results may be illustrated in several ways. For instance, a team result may be illustrated using a single bar in a bar graph. An exemplary illustration is provided in FIG. 5C at display 540. The bar 550 is broken up into three colors or shades, with each shade representing the contribution of one of the three highest outcomes. Thus, if a team result consists of outcomes paying, for example, 25, 50, and 50 coins, then the bar 550 may stretch from 0 to 125, and may be colored green from 0 to 25, red from 25 to 75, and yellow from 75 to 125. Of course the bar 550 could be more creatively textured, using for example, outcome indicia, coins, dollar signs, and so on. Each portion of the bar 550 may be tagged to illustrate the size of the payout, or the outcome that contributed to the leg of the bar. For example, the bottom portion of the bar 550 may be tagged "25", the next lowest portion "50", and so on. Each portion of the bar 550 may also be tagged with the name of the person who obtained the corresponding outcome.

In general, any graphic may be used to show how individual outcomes contribute to a larger team outcome, wherein some dimension or other statistic describing the graphic is in a fixed proportion to the amount of the contribution to the team result represented by the graphic. In the example of the bar graph above, the length of each leg of the bar is proportional to the payout of the outcome illustrated by the leg. Of course, the statistic or dimension need not be in a fixed proportion to the amount of the contribution. For example, the length of the leg of a bar graph corresponding to the player contributing the greatest amount may be displayed disproportionately (e.g., disproportionately larger) or otherwise displayed prominently.

In one embodiment, the display of a team member's slot machine 300 must continually update the display of the highest five outcomes obtained by the team thus far. This is because, as the session progresses, players are likely to occasionally achieve outcomes that place in the top five of outcomes generated up to that point in the session. Therefore, the display of the slot machine must remove the now sixth-highest outcome being displayed and display the newly achieved outcome that has placed in the top five.

The continual removal of the sixth-highest outcome, and its replacement with a new outcome, can be graphically illustrated using a bucket metaphor. An exemplary illustration is provided in FIG. 5D at display 560. As a new outcome 570 places in the top five, it is placed in the top of a bucket. The sixth-highest outcome 580 then falls out the bottom of the bucket, and is discarded. In various embodiments of the present invention, those outcomes not placing high enough to replace a previous outcome may be displayed as falling outside of the bucket, and/or all the way through the bucket.

There are, of course, many possible variations to this metaphor. For instance, five outcomes may be displayed as lined up, in numerical order (or in order of outcome value, or in order achieved), at the edge of a cliff. Of course, the outcomes need not be displayed in any particular order. When a new outcome having a value greater than the fifth-highest outcome comes in, for example, it jostles the line, causing the now sixth-highest outcome to fall off the edge of the cliff.

Alternatively, the outcomes may be any predetermined set of outcomes (e.g., the second through seventh highest outcomes; or all outcomes above a threshold value). In such embodiments, when a new outcome having a value greater than the lowest outcome of the group is achieved, for example, the new outcome causes the lowest outcome to fall out of the bucket, or off the edge of the cliff.

At the end of a session, the outcomes remaining in the bucket, for example, are used to determine the team result. For example, the team result may consist of the four highest outcomes, the six highest outcomes, or numerous other possible combinations of outcomes (e.g., the second, fourth, and fifth highest outcomes).

In some embodiments, a team may achieve a team result that qualifies the team for a bonus game. For example, if the team result exceeds a certain threshold, then the team may enter a bonus round. According to various embodiments, one or more of the team players may have the opportunity to make a decision in a bonus round that affects the outcome of the bonus round. For instance, in a bonus round involving a fantasy forest scene, each team member may suggest a tree beside which to dig for buried treasure. If one of the trees does yield the treasure, then the entire team receives a prize associated with the treasure. Each team player may make his decision from his own slot machine. In one embodiment of the present invention, each team member may view the same virtual scene, and watch as holes are dug beside the trees chosen by each team member.

Based on the identified team session result, each CPU 310 locates the corresponding payout in the appropriate field of the per-session payout database 1200, shown in FIG. 12, based on the number of team players currently playing. When a payout is awarded to the per-session team players, the slot machine 300 stores the credits in a random access memory (RAM) (not shown) or dispenses the appropriate number of coins using the hopper controller 352 and hopper 354.

A player tracking device 360 is also in communication with the CPU 310. The player tracking device 360 comprises a card reader 364 for reading player identification information stored on a player tracking card (not shown), which is preferably encoded with information to identify the player, in a known manner. The player tracking device 360 also preferably includes a display 362, having an associated player interface, such as a numeric keypad 363 for entry of player information. The player card tracking device may be embodied, for example, as the Mastercom device, commercially available from Bally Manufacturing. For a discussion of player card tracking devices, see, for example, U.S. Pat. No. 5,429,361 to Raven et al., incorporated by reference herein.

The slot machine 300 also includes a slot network interface 376 that provides a communication path between the representative slot machine 300 and the slot server 200. Thus, as discussed further below, information may be communicated among the player tracking device 360, slot machine 300 and slot server 200.

Databases

As previously indicated, the player database 600, shown in FIG. 6, stores information on each player, including an identifier of each player's team (or teams), if any, and the player's loyalty reward points balance. The player database 600 maintains a plurality of records, such as records 605 through 620, each associated with a different player. For each player identified by a player identifier in field 630, the player database 600 includes the name and address of the player in fields 635 and 640, respectively. In addition, the player database 600 includes an identifier of each team the player is associated with in field 645. Finally, the player database 600 includes each player's current loyalty reward points balance in field 650. As previously indicated, the registered team database 700, shown in FIG. 7, stores information on each team that is registered for slot machine play, including an identification of each team member. The registered team database 700 maintains a plurality of records, such as records 705 and 710, each associated with a different team. For each team identified by a team identifier in field 720, the registered team database 700 includes an indication of each team player in fields 725 through 735, and the duration of each session for the illustrative per-session embodiment in field 740. In this manner, the slot server 200 can determine the names and player identifiers of each player on a given team.

A team database might further include team preferences. By storing team preferences, a slot server 200 could make it easier for a team to begin a playing session similar in nature to a prior team session. Team preferences might include the preferred type of slot machine to be used by a team, the preferred game to be played on a slot machine, the preferred length of a session, the preferred method of combining individual results into team results, the preferred method by which individual game results are to be displayed to other team members, and so on.

Figure 8:
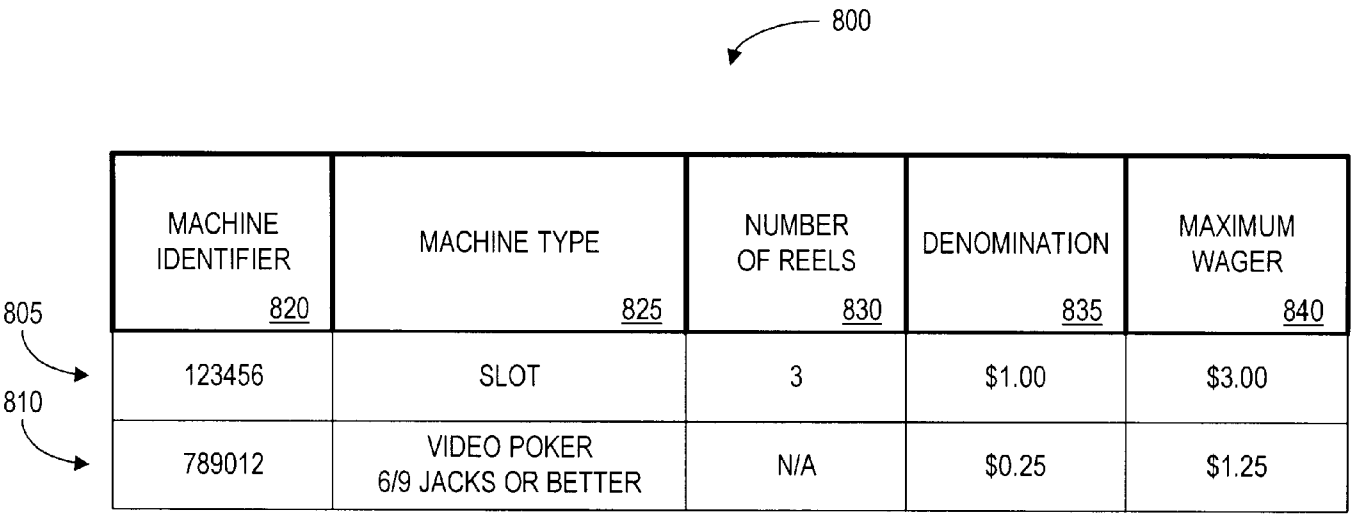
FIG. 8 illustrates a sample table from the machine database of FIG. 2.

As previously indicated, the machine database 800, shown in FIG. 8, stores information on each slot machine in a casino, including the type of each machine. The machine database 800 maintains a plurality of records, such as records 805 and 810, each associated with a different slot machine, such as the slot machine 300. For each slot machine identified by a machine identifier in field 820, the illustrative machine database 800 indicates the machine type in field 825, and the associated number of reels, possible denominations and maximum wager in field 830 through 840, respectively. In this manner, the slot server 200 can determine if each team player is utilizing a compatible slot machine 300–303.

As previously indicated, the per-spin transaction database 900, shown in FIG. 9, stores play results for each team playing in a per-spin embodiment of the present invention. The per-spin transaction database 900 maintains a plurality of records, such as records 905 and 910, each associated with a different team. For each team identified by a team identifier in field 920, the per-spin transaction database 900 includes the per-spin results for each team player in fields 930, 940 and 950. Specifically, for a first team player, the per-spin results include an identifier of the player in field 931, the corresponding game result in fields 932 through 934, and an identifier of the machine utilized by the player in field 935. In this manner, the slot server 200 can analyze the per-spin individual game results of each player on a given team and combine them in a predefined manner to obtain a team game result. In one embodiment, the individual game results are combined by selecting the symbol in each reel position that provides the team with the best overall game result having the highest payout.

As previously indicated, the per-session transaction database 1000, shown in FIG. 10, stores play results for each team playing in a per-session embodiment of the present invention. The per-session transaction database 1000 maintains a plurality of records, such as records 1005 and 1010, each associated with a different team. For each team identified by a team identifier in field 1020, the per-session transaction database 1000 includes the to-date session results for each team player in fields 1030, 1040 and 1050. Specifically, for a first player, the to-date session results include an identifier of the player in field 1031, an identifier of the machine utilized by the player in field 1032, and the current coin-in, coin-out and net values (coin-out less coin-in) in fields 1033 through 1035, respectively. In this manner, upon completion of a defined session, the slot server 200 can combine the individual net results of each team player to obtain the team session result. In one embodiment, the individual net results are combined by selecting the highest net result of each player on a given team and adjusting the coin-out of the additional players to obtain the same net result. As previously indicated, the per-spin payout database 1100, shown in FIG. 11, stores the payouts associated with each winning reel combination for a number of team sizes, for the per-spin embodiment. The per-spin payout database 1100 maintains a plurality of records, such as records 1102–1134, each associated with a different possible game result. For each possible game result identified in field 1140, the per-spin payout database 1100 includes the corresponding prize awarded for a single player, two member team and three member team in fields 1150 through 1170, respectively.

For example, if a single player not associated with a team hits the reel combination "orange/orange/orange," shown in record 1118, the player will be awarded 20 credits for the illustrative one-coin wager model. Likewise, if the team game result for a two member team is the reel combination "orange/orange/orange," each member of the team will be awarded 10 credits for the illustrative one-coin wager model. In a multiple coin play embodiment of the slot machine 300, the per-spin payout database 1100 can include additional fields for recording payouts associated with the number of coins wagered by the player, as well as the corresponding team size, as would be apparent to a person of ordinary skill in the art. Generally, the payout for a given game result decreases as the size of a team increases, to compensate for the increased probability of a winning game result.

As previously indicated, the per-session payout database 1200, shown in FIG. 12, stores the payouts associated with each winning reel combination for a number of team sizes, for the per-session embodiment. The per-session payout database 1200 maintains a plurality of records, such as records 1202–1234, each associated with a different possible game result. For each possible game result identified in field 1240, the per-session payout database 1200 includes the corresponding prize awarded for a single player, two member team and three member team in fields 1250 through 1270, respectively.

For example, if a single player hits the reel combination "orange/orange/orange," shown in record 1218, the player will be awarded 20 credits for the illustrative one-coin wager model. Likewise, if a player from a two member team hits the reel combination "orange/orange/orange," on an individual pull of a team session, the individual player will be awarded 15 credits for the illustrative one-coin wager model. In a multiple coin play embodiment of the slot machine 300, the per-spin payout database 1200 can include additional fields for recording payouts associated with the number of coins wagered by the player, as well as the corresponding team size, as would be apparent to a person of ordinary skill in the art. Because player net results approach the expected value return as the number of plays in the session increases, per-session payout database 1200 may be modified to generally increase payout levels for longer sessions.

As previously indicated, the per-spin probability database 1300, shown in FIG. 13, stores the probability that a given reel combination will result for a number of team sizes in the per-spin embodiment, for an illustrative slot machine having three reels, each with two hundred twenty (220) virtual reel stop positions. The number of reel stops on each reel of the illustrative per-spin embodiment of the present invention has been increased by a factor of ten over a conventional twenty-two stop machine, in order to permit the probability of the occurrence of the "seven" symbol (7) to be reduced for team sizes greater than one. It is noted that a game result is selected in the illustrative per-spin embodiment by generating three random numbers and looking up the result in the per-spin probability database 1300.

The per-spin probability database 1300 maintains a plurality of records, such as records 1305–1330, each associated with a different reel symbol. For each reel symbol identified in field 1140, the per-spin probability database 1300 indicates the number of times, on average, that the reel symbol will result on each reel for each 220 token plays of the slot machine 300 in fields 1351–1353, 1361–1363 and 1371–1373 for a single player, two member team and three member team, respectively. In an alternate embodiment, the probability of a winning game result can be reduced by dynamically increasing the number of reels 332, 334, 336.

As previously indicated, the per-session probability database 1400, shown in FIG. 14, stores the probability that a given reel combination will result for a number of team sizes in the per-session embodiment, for an illustrative slot machine having three reels, each with twenty two (22) symbols. Thus, as shown in field 1252 of record 1202, 8,570 combinations out of a possible 10,648 reel combinations result in a nonwinning game result for a single player in a per-session embodiment.

The per-session probability database 1400 maintains a plurality of records, such as records 1402–1436, each associated with a different possible game result. For each possible game result identified in field 1440, the per-session probability database 1400 includes the random numbers which lead to that reel combination for a single player in field 1452, and the corresponding number of times, on average, that the game result will occur for each 10,648 token plays of the slot machine 300 in field 1454. Likewise, the per-session probability database 1400 indicates the random numbers and corresponding expected hits per cycle for the two member team and three member team in fields 1462–1464 and 1472–1474, respectively.

For example, the game result "orange/orange/orange," shown in record 1420 of the per-session probability database 1400, will be theoretically expected 42 times for each 10,648 token plays of the illustrative slot machine 300 by a single player of the per-session embodiment. In an illustrative embodiment, the symbol "orange" appears twice on reel number one, three times on reel number two, and seven times on reel number three. Thus, the probability that the game result "orange/orange/orange" will result is 42 (2×3×7) out of the total 10,648 possible game results (22×22×22) for a single player of the per-session embodiment. Likewise, the probability that the game result "orange/orange/orange" will result is 30 out of the total 10,648 possible game results for a player from a two member team on an individual pull of a team session.

The expected hits per cycle for the multiple player teams set forth in fields 1460 and 1470 are similar to those set forth in field 1450 for an individual player, except for the decreased probability of a number of winning game results (in order to find team play). There are a number of ways to accomplish a decrease in the probability of a winning combination. In the illustrative example shown in FIG. 14, the probability of a winning combination for the multiple player teams has been decreased by increasing the number of nonwinning combinations for the multiple player teams, and providing a corresponding decrease to the winning combinations. For example, when random numbers in the range 8571 through 8917 are generated, they will result in nonwinning combinations for the two member team, as opposed to winning combinations for the individual player. In an alternative embodiment, a decrease in the probability of a winning combination for team play can be achieved by reallocating the symbol-to-reel allocation utilized by the slot machine 300 by increasing the number of symbols which do not contribute to winning combinations.

It is again noted that the representative data provided in the per-spin and per-session payout databases 1100, 1200 and the per-spin and per-session probability databases 1300, 1400 are meant to be examples of values that could be utilized to keep the house advantage approximately the same for team play as for individual play with conventional slot machines, as would be apparent to a person of ordinary skill in the art.

Processes

As previously indicated, the slot server 200 and the individual slot machines 300–303 being utilized by team players execute a number of cooperative processes in order to coordinate team play in both the per-spin and per-session embodiments. As discussed below in conjunction with FIGS. 15 and 16, the individual slot machines 300–303 and the slot server 200 each execute per-spin processes 1500, 1600, respectively, to implement the per-spin embodiment of the present invention. Likewise, as discussed below in conjunction with FIGS. 17 and 18, the individual slot machines 300–303 and the slot server 200 each execute per-session processes 1700, 1800, respectively, to implement the per-session embodiment of the present invention.

Figure 15A:
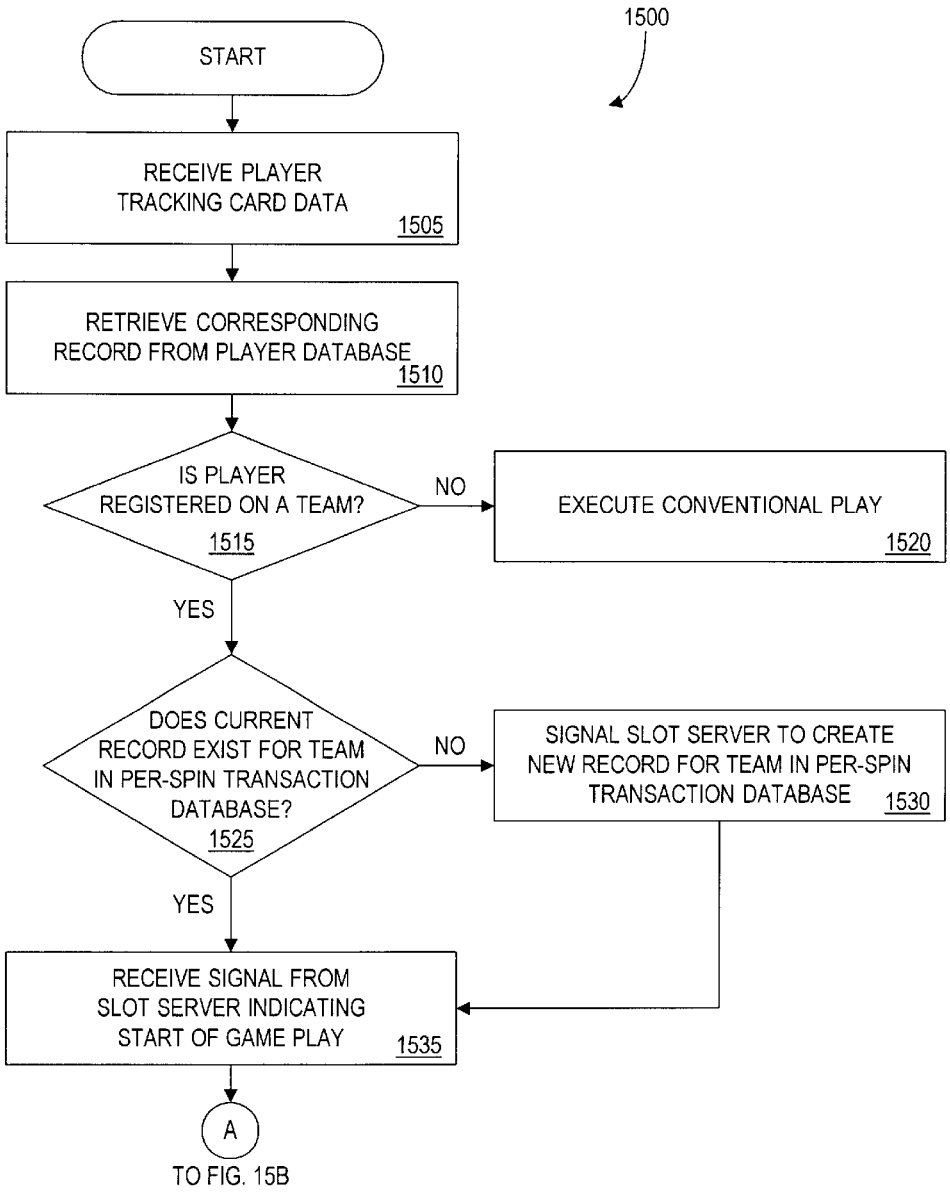
FIGS. 15A through 15C, collectively, are a flowchart describing an exemplary per-spin process implemented by the slot machine of FIG. 3.
Figure 15B:
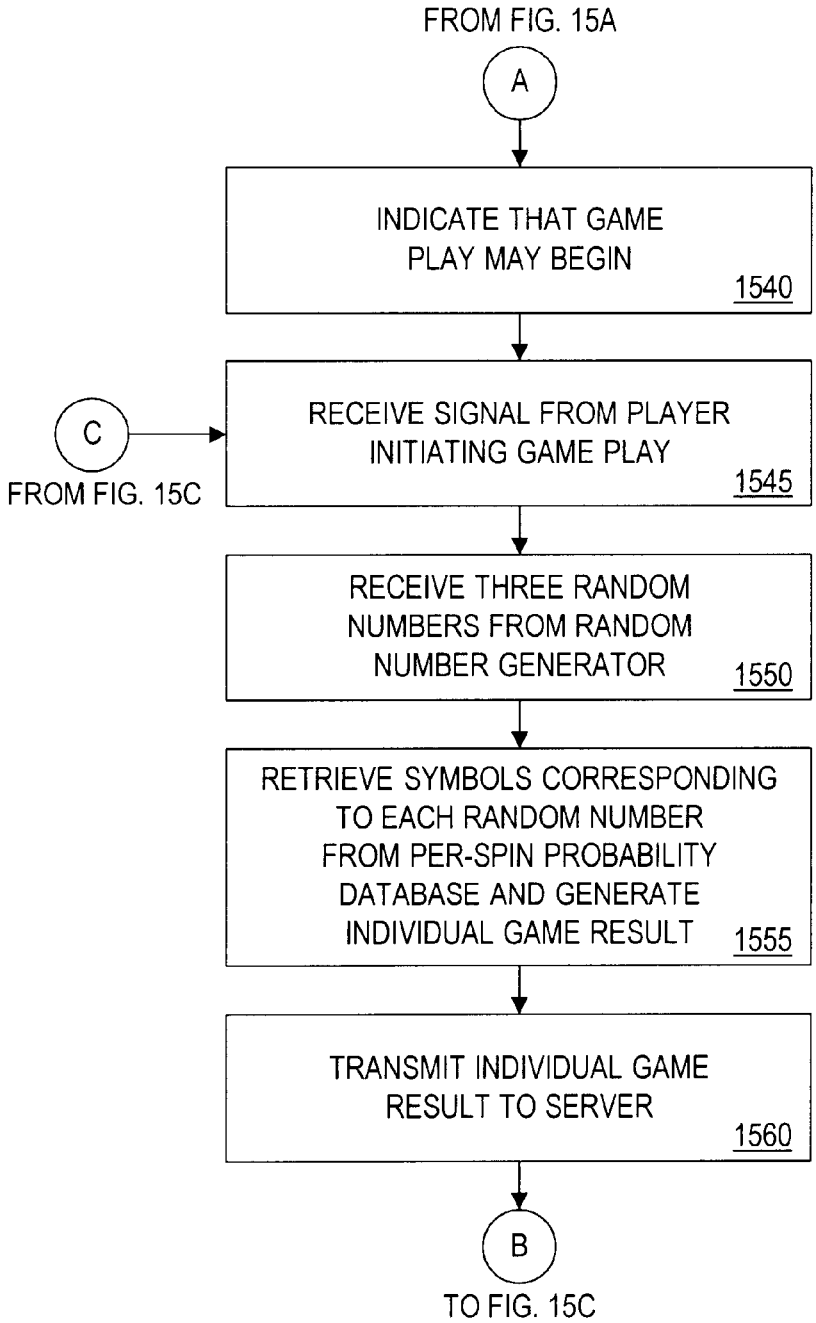
Figure 15C:
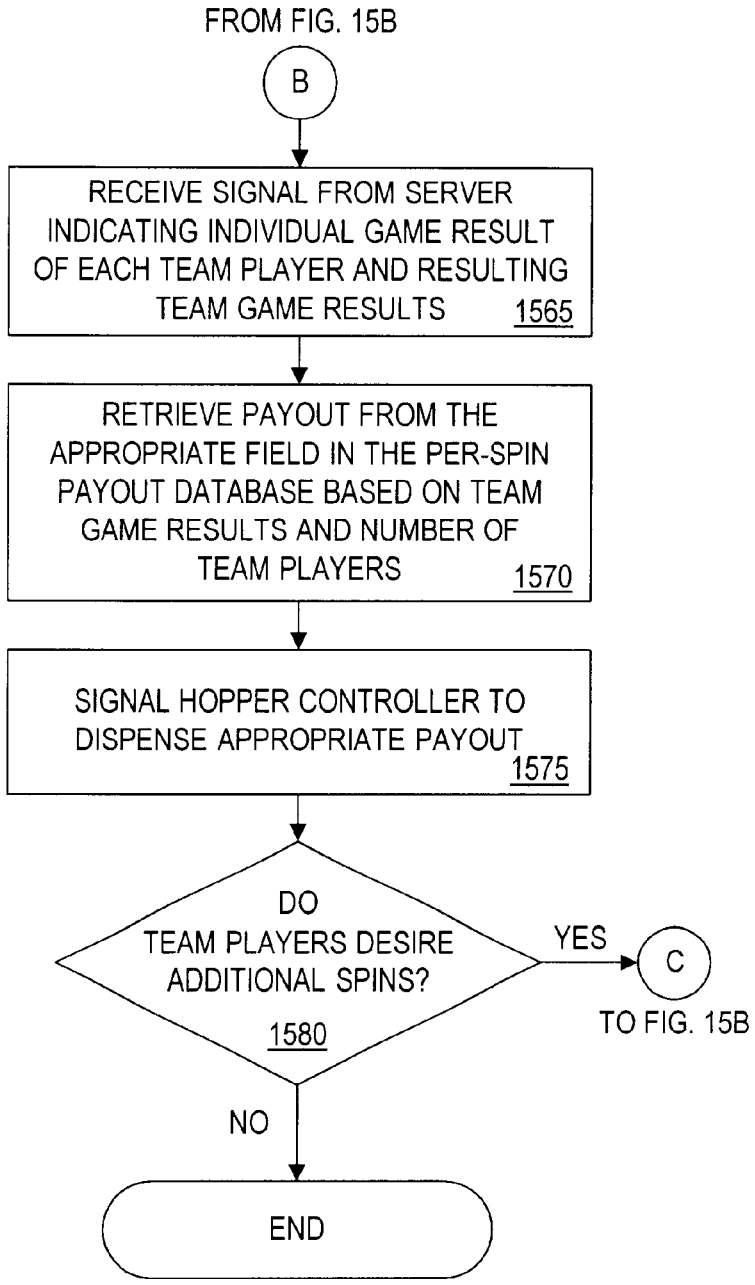

As shown in FIG. 15A, in the per-spin embodiment, an individual representative slot machine 300 initiates the per-spin process 1500 upon receipt of player tracking data from the player tracking device 360 during step 1505. The slot machine 300 then retrieves the corresponding record from the player database 600, which may be stored locally or at the slot server 200, during step 1510.

A test is performed during step 1515 to determine if the player is registered on a team. If it is determined during step 1515 that the player is not registered on a team, then conventional slot machine play will continue during step 1520. If, however, it is determined during step 1515 that the player is registered on a team, then a further test is performed during step 1525 to determine if a record exists for the team in the per-spin transaction database 900. If it is determined during step 1525 that a record does not exist for the team in the per-spin transaction database 900, then the slot machine 300 signals the slot server 200 to create a new record for the team in the per-spin transaction database 900 during step 1530, before program control proceeds to step 1535.

The slot machine 300 receives a signal from the slot server 200 during step 1535 indicating the start of team play. The slot machine 300 then indicates to the player during step 1540 (FIG. 15B) that game play may begin and receives a signal from the player initiating game play during step 1545. Three random numbers are obtained from the random number generator 378 during step 1550. The symbols corresponding to each random number are then retrieved from the per-spin probability database 1300 during step 1555 and the individual game result is generated for the team player. The individual game result is then transmitted to the slot server 200 during step 1560.

Thereafter, each individual slot machine 300–303 where team players are playing receives a signal from the slot server 200 during step 1565 (FIG. 15C) indicating the individual game result of each team player and the resulting team game result. The appropriate payout is retrieved from the per-spin payout database 1100 during step 1570, based on the team game result and the number of team players. The hopper controller 352 is instructed to dispense the appropriate payout to the team player during step 1575. A test is performed during step 1580 to determine if the team players desire additional spins. If it is determined during step 1580 that the team players do desire additional spins, then program control returns to step 1545 (FIG. 15B) for further play in the manner described above. If, however, it is determined during step 1580 that the team players do not desire further spins, then program control will terminate.

Figure 16A:
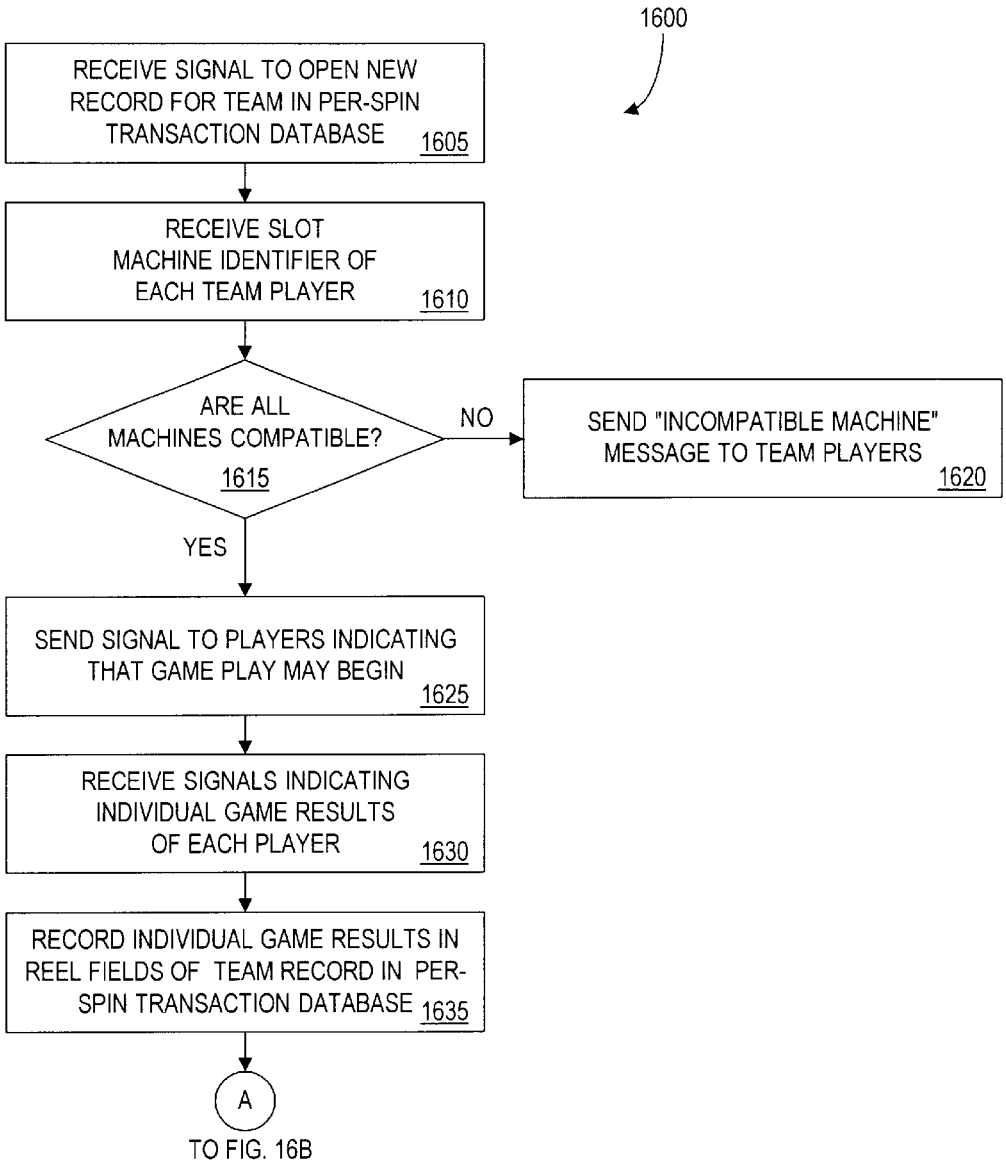
FIGS. 16A and 16B, collectively, are a flowchart describing an exemplary per-spin process implemented by the slot server of FIG. 2.
Figure 16B:
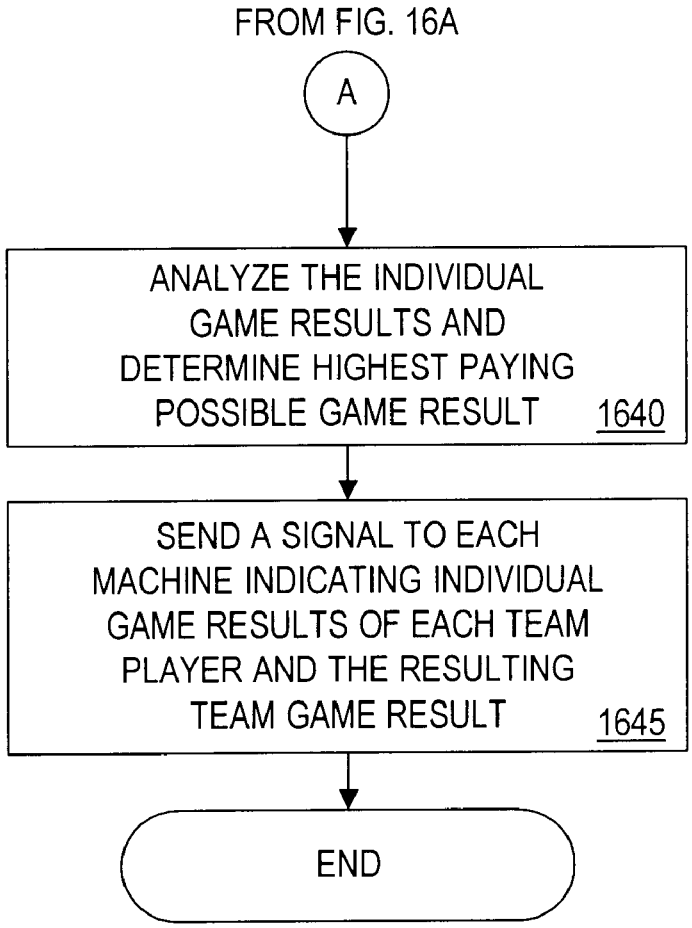

As previously indicated, the slot server 200 executes a per-spin process 1600, shown in FIG. 16, in cooperation with the per-spin processes 1500 being executed by the individual slot machines 300–303 being utilized by team players. As shown in FIG. 16A, the slot server 200 initiates the per-spin process 1600 upon receipt of a signal from one or more of the individual slot machines 300–303 being utilized by team players during step 1605 to open a new record for a team in the per-spin transaction database 900. Thereafter, the slot server 200 will receive an identifier of each of the individual slot machines 300–303 being utilized by team players during step 1610.

A test is performed during step 1615 to determine if each of the individual slot machines 300–303 being utilized by team players are compatible. If it is determined during step 1615 that each of the individual slot machines 300–303 being utilized by team players are not compatible, then a message is sent to each of the individual slot machines 300–303 being utilized by team players during step 1620 indicating that one or more of the machines are not compatible. If, however, it is determined during step 1615 that each of the individual slot machines 300–303 being utilized by team players are compatible, then a signal is sent to the team players during step 1625 indicating that game play may begin.

After each spin, the slot server 200 receives signals from each of the individual slot machines 300–303 being utilized by team players during step 1630 indicating the individual game results of each team player. The individual game results are then recorded in the appropriate team record in the per-spin transaction database 900 during step 1635. The slot server 200 analyzes the individual game results during step 1640 (FIG. 16B) and then determines the team game result providing the highest possible payout. The slot server 200 then sends a signal to each of the individual slot machines 300–303 being utilized by team players during step 1645 indicating the individual game results of each team player, and the resulting team game result, before program control terminates.

Figure 17A:
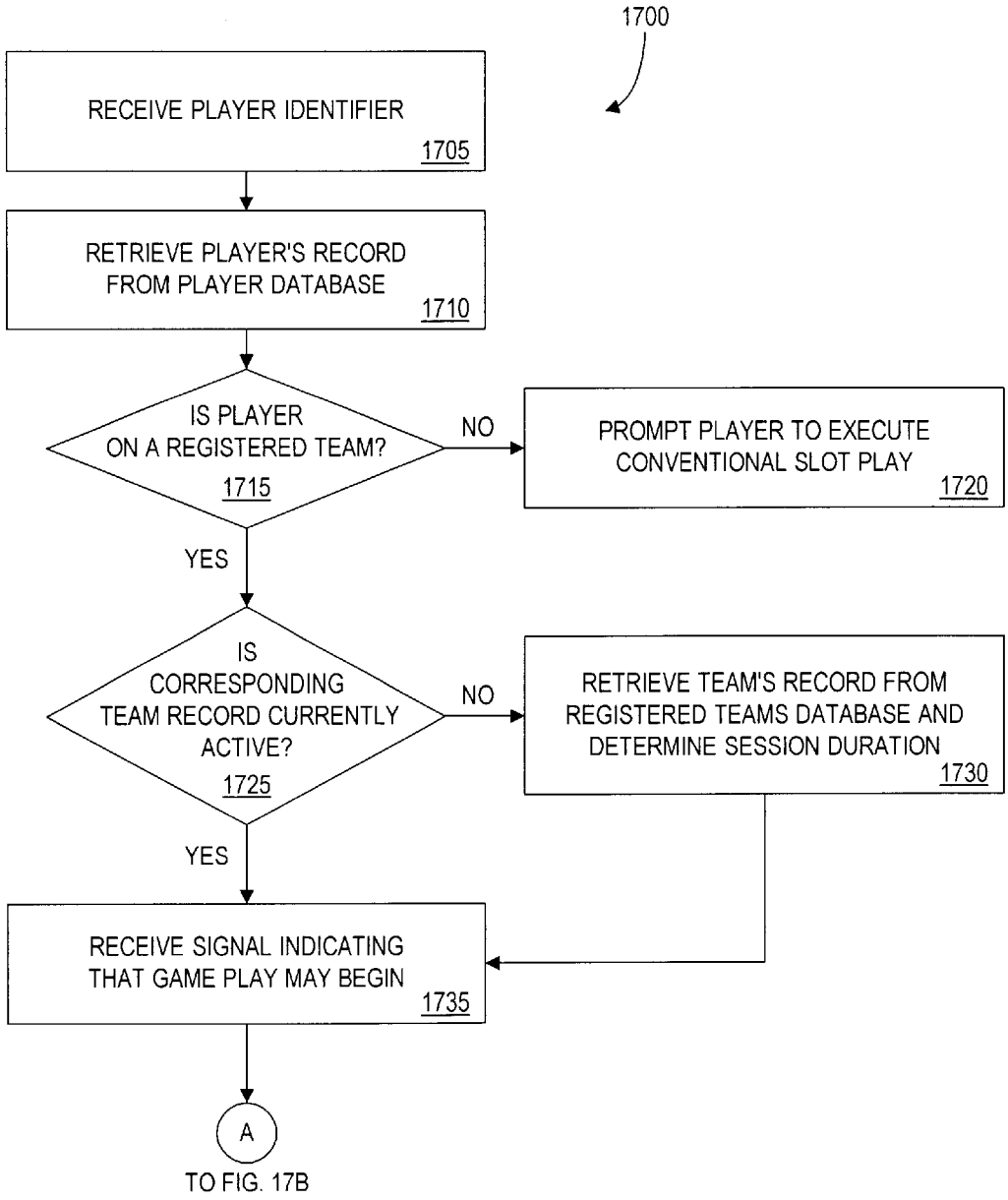
FIGS. 17A through 17C, collectively, are a flow chart describing an exemplary per-session process implemented by the slot machine of FIG. 3.
Figure 17B:
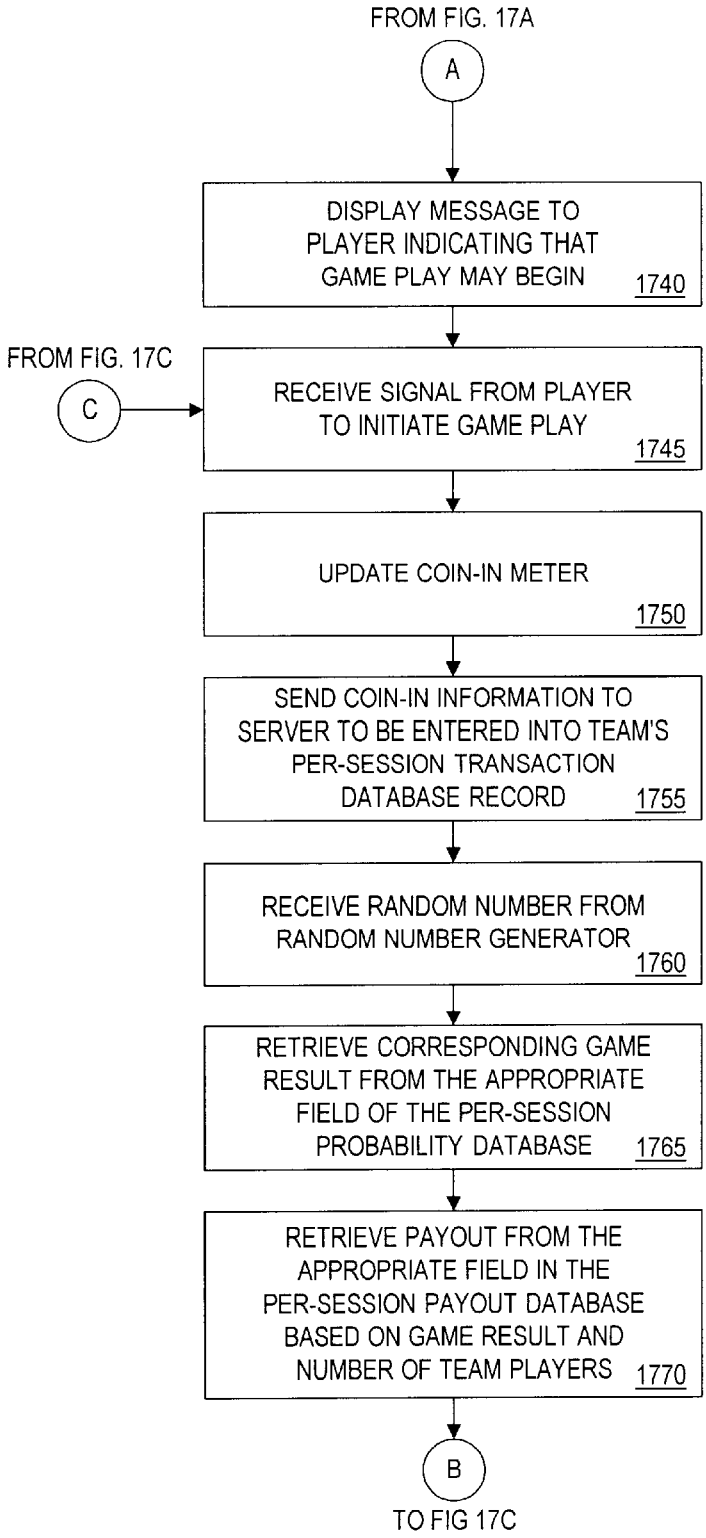
Figure 17C:
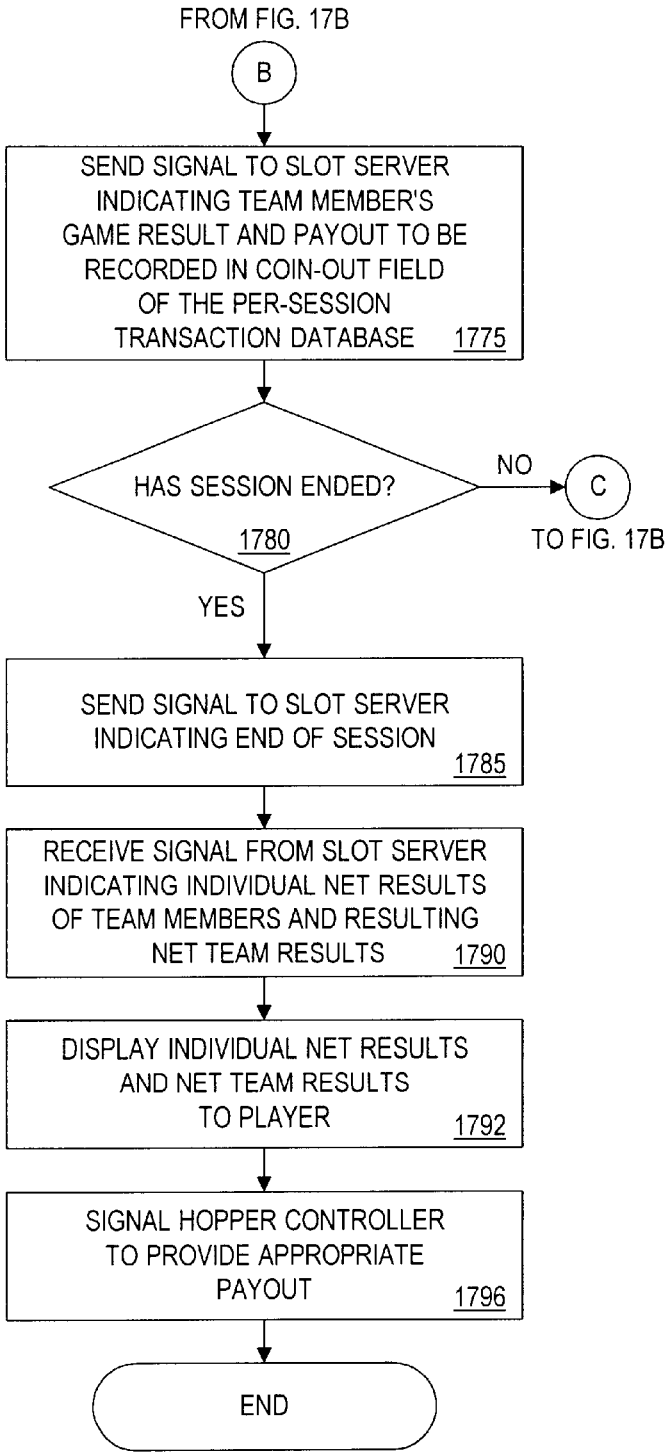
Figure 18A:
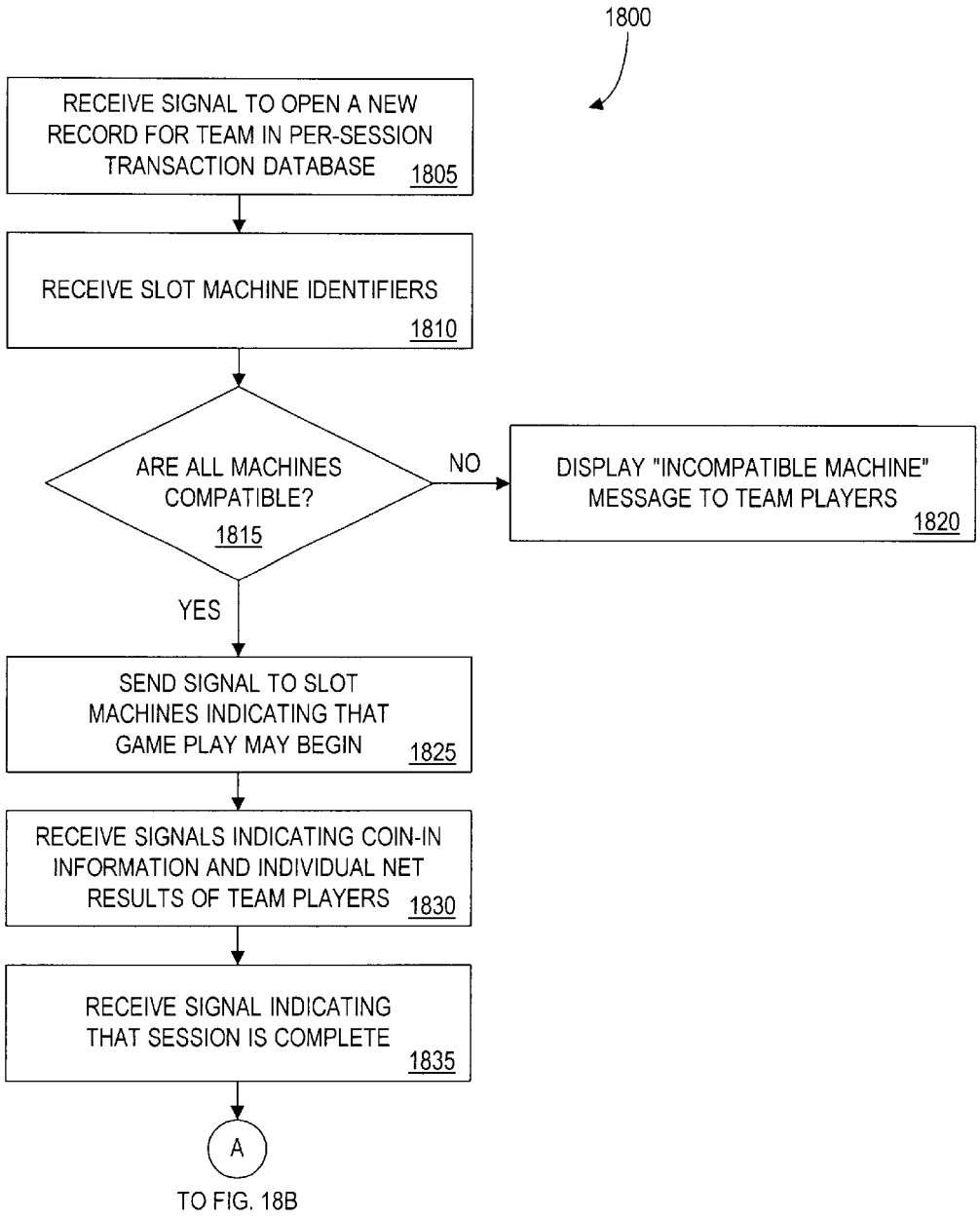
FIG. 18 is a flow chart describing an exemplary per-session process implemented by the slot server of FIG. 2.
Figure 18B:
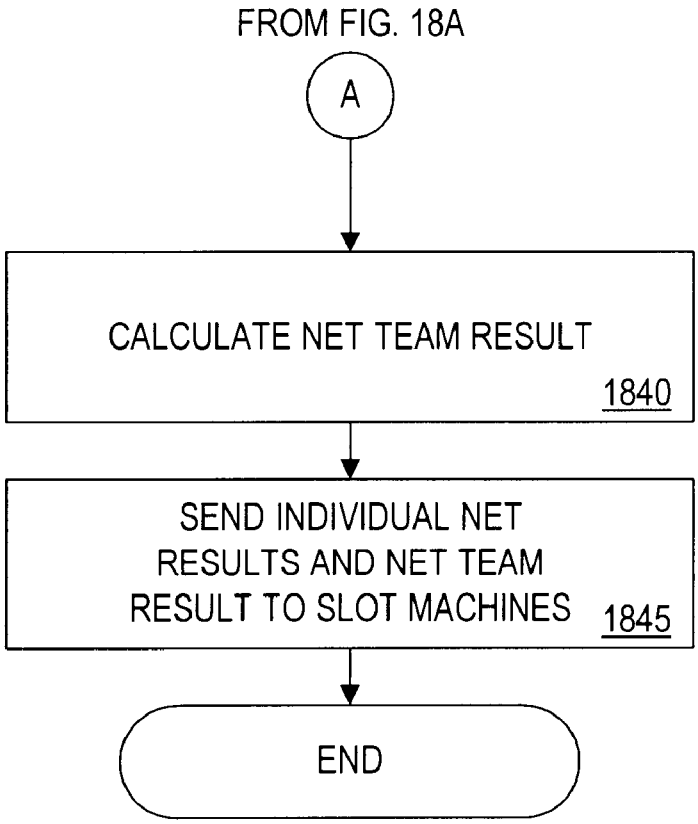

As previously indicated, the individual slot machines 300–303 and the slot server 200 each execute per-session processes 1700, 1800, shown in FIGS. 17 and 18, respectively, to implement the per-session embodiment of the present invention. As shown in FIG. 17A, in the per-session embodiment, an individual representative slot machine 300 initiates the per-session process 1700 upon receipt of player tracking data from the player tracking device 360 during step 1705. The slot machine 300 then retrieves the corresponding record from the player database 600, which may be stored locally or at the slot server 200, during step 1710.

A test is performed during step 1715 to determine if the player is registered on a team. If it is determined during step 1715 that the player is not registered on a team, then conventional slot machine play will continue during step 1720. If, however, it is determined during step 1715 that the player is registered on a team, then a further test is performed during step 1725 to determine if a record exists for the team in the per-session transaction database 1000. If it is determined during step 1725 that a record does not exist for the team in the per-session transaction database 1000, then the slot machine 300 signals the slot server 200 to create a new record for the team in the per-session transaction database 1000 during step 1730, before program control proceeds to step 1735.

The slot machine 300 receives a signal from the slot server 200 during step 1735 indicating the start of team play. The slot machine 300 then indicates to the player during step 1740 (FIG. 17B) that game play may begin and receives a signal from the player initiating game play during step 1745. The coin-in meter is updated during step 1750 to indicate the number of coins (or other form of payment) deposited by the player to initiate play. In addition, the coin-in information is sent to the slot server 200 during step 1755 for entry in the appropriate team record of the per-session transaction database 1000.

A random number is received from the random number generator 378 during step 1760, which is utilized during step 1765 to retrieve the corresponding game result from the appropriate field of the per-session probability database 1400. The payout corresponding to the retrieved game result is then retrieved during step 1770 from the per-session payout database 1200, based on the game result and the number of team players.

A signal is sent to the slot server 200 during step 1775 (FIG. 17C) indicating the team member's game result and payout for recording in the coin-out field of the per-session transaction database 1000. A test is performed during step 1780 to determine if the session has ended. If it is determined during step 1780 that the session has not ended, program control returns to step 1745 (FIG. 17B) for further play in the manner described above. If, however, it is determined during step 1780 that the session has ended, then a signal is sent to the slot server 200 during step 1785 indicating the end of the session.

Thereafter, a signal is received from the slot server 200 during step 1790 indicating the individual net results of each team player, and the resulting team session result. The individual net results and team session results are displayed to each team player during step 1792 using display 510 (FIG. 5A), and the appropriate payout is awarded to each team player during step 1796, before program control terminates.

As previously indicated, the slot server 200 executes a per-session process 1800, shown in FIG. 18, in cooperation with the per-session processes 1700 being executed by the individual slot machines 300–303 being utilized by team players. As shown in FIG. 18, the slot server 200 initiates the per-session process 1800 upon receipt of a signal from one or more of the individual slot machines 300–303 being utilized by team players during step 1805 to open a new record for a team in the per-session transaction database 1000. Thereafter, the slot server 200 will receive an identifier of each of the individual slot machines 300–303 being utilized by team players during step 1810.

A test is performed during step 1815 to determine if each of the individual slot machines 300–303 being utilized by team players are compatible. If it is determined during step 1815 that each of the individual slot machines 300–303 being utilized by team players are not compatible, then a message is sent to each of the individual slot machines 300–303 being utilized by team players during step 1820 indicating that one or more of the machines are not compatible. If, however, it is determined during step 1815 that each of the individual slot machines 300–303 being utilized by team players are compatible, then a signal is sent to the team players during step 1825 indicating that game play may begin.

As per-session play continues, the slot server 200 will receive signals from each of the individual slot machines 300–303 being utilized by team players during step 1830, indicating the coin-in information and the individual net results of team players. Thereafter, once the session has ended, the slot server 200 will receive a signal from one or more of the individual slot machines 300–303 being utilized by team players during step 1835, indicating that the session is complete.

The slot server 200 calculates the team session result during step 1840. The slot server 200 then transmits the individual net results of each team player and the team session result to each of the individual slot machines 300–303 being utilized by team players during step 1845, before program control terminates.

As previously indicated, the present invention may be applied to video poker machines, as well as to the illustrative slot machines 300–303. In a video poker implementation, the game results of each player on a given team are combined, and the result providing the highest payout, is provided to each of the team members. The game results of each player on a given team may be combined, for example, by compiling the cards from every team player and selecting the hand with the highest possible payout from all of the drawn cards. In a further variation, each of the players on a team are dealt the same hand, and draw additional cards in a conventional manner. The best hand drawn by one of the team players is then selected as the team result. If more than one player on the team gets the same highest payout result, a bonus can be awarded to the team. In this manner, a team strategy where every player always picks a different draw combination than the other players is discouraged.

In yet another variation, each of the players on a team is dealt the same hand, and then votes on a strategy for which cards to hold, such as holding a pair. The slot server 200 then analyzes the votes and implements the strategy having the highest votes. If the resulting hand is a winning hand, the team players are awarded the resulting payout. Team players can consult with one another, to increase player interaction and permit team players to receive the input and experience of all the other team players towards achieving a payout.

According to various embodiments of this invention, team players may communicate with one another during the course of play. For instance, each team player's slot machine may contain a microphone and speaker. A team member may speak into the microphone of his slot machine. The slot machine may then transmit audio to other team players' slot machines via the slot network. The speakers of the other team players' slot machines may then broadcast the first team player's message. According to various embodiments, team players may also communicate via text or symbolic messages keyed into their respective slot machines using a standard "qwerty" keyboard, or any other buttons or keys. Team players may also key or write messages into their slot machines using the display screen of the slot machine. Communication among team players may allow team players to provide hints and advice to each other on any games requiring decisions. Communication may also allow team players to cheer each other on, to congratulate each other, to console each other, and so on.

Virtual tournaments are possible, with a plurality of teams competing against one another for the highest team session result. According to various embodiments, all or a portion of the team session results could be displayed to a team player participating in the tournament. For example, a player could view his own team's result, as described above, in addition to the team results of the top five teams. Alternatively, or in addition, the results of individual players participating in the tournament could be displayed.

It is to be understood that the embodiments and variations shown and described herein are merely illustrative of the principles of this invention and that various modifications may be implemented by those skilled in the art without departing from the scope and spirit of the invention.

We claim:

1. A method comprising:

determining a first result of play of a first gaming device, the first gaming device corresponding to a first player, in which the first result comprises a first plurality of symbols;

determining a second result of play of a second gaming device, the second gaming device corresponding to a second player, in which the second result comprises a second plurality of symbols;

transmitting an indication of the second result of play to the first player;

determining a team result based on the first result and the second result, in which the team result includes at least one of the first plurality of symbols and at least one of the second plurality of symbols; and displaying a representation of the team result to the first player.

2. The method of claim 1, in which transmitting the indication of the second result comprises:

displaying the second plurality of symbols to the first player.

3. The method of claim 2, further comprising:

displaying the first plurality of symbols to the first player.

4. The method of claim 3, in which displaying the second plurality of symbols comprises:

displaying the second plurality of symbols while displaying the first plurality of symbols.

5. The method of claim 2, in which displaying the representation of the team result comprises:

highlighting the at least one of the second plurality of symbols that is included in the team result.

6. The method of claim 2, in which displaying the representation of the team result comprises:

underlining the at least one of the second plurality of symbols that is included in the team result.

7. The method of claim 2, in which displaying the representation of the team result comprises:

outlining the at least one of the second plurality of symbols that is included in the team result.

8. The method of claim 2, in which displaying the representation of the team result comprises:

representing the at least one of the second plurality of symbols that is included in the team result as being in motion.

9. The method of claim 2, in which displaying the representation of the team result comprises:

displaying intermittently the at least one of the second plurality of symbols that is included in the team result.

10. The method of claim 1, in which displaying the representation of the team result comprises:

displaying the second plurality of symbols to the first player; and bringing to prominence the at least one of the second plurality of symbols that is included in the team result.

11. The method of claim 1, in which the first plurality of symbols comprises at least one reel symbol.

12. The method of claim 1, in which the first plurality of symbols comprises at least one card symbol.

13. The method of claim 1, in which the first plurality of symbols comprises at least one number.

14. The method of claim 1, in which displaying the representation of the team result comprises:

displaying the representation at a display of the first gaming device.

15. The method of claim 1, further comprising:

determining a payout based on the team result.

16. The method of claim 15, further comprising:

providing the payout to the first player.

17. A method comprising:

determining a first result of play of a first gaming device;

determining a second result of play of a second gaming device;

determining a team result based on the first result and the second result, in which the first result comprises a first plurality of indicia, in which the second result comprises a second plurality of indicia, and in which the team result includes at least one of the first plurality of indicia and at least one of the second plurality of indicia; and displaying a representation of the team result at the first gaming device.

18. The method of claim 17, in which displaying the representation of the team result comprises:

displaying a representation of the at least one of the first plurality of indicia that is included in the team result.

19. The method of claim 17, in which displaying the representation of the team result comprises:

displaying a representation of the second plurality of indicia; and highlighting the at least one of the second plurality of indicia that is included in the team result.

* * * * *